US008815482B2

(12) United States Patent
Takamiya et al.

(10) Patent No.: US 8,815,482 B2
(45) **Date of Patent: *Aug. 26, 2014**

(54) TRANSPARENT ELECTROSTATIC CHARGE IMAGE DEVELOPING TONER AND METHOD OF MANUFACTURING THE SAME, ELECTROSTATIC CHARGE IMAGE DEVELOPER, TONER CARTRIDGE, IMAGE FORMING METHOD, AND IMAGE FORMING APPARATUS

(75) Inventors: Yuki Takamiya, Kanagawa (JP); Tsuyoshi Murakami, Kanagawa (JP); Eisuke Iwazaki, Kanagawa (JP); Satoshi Yoshida, Kanagawa (JP); Satoshi Inoue, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/542,085

(22) Filed: Jul. 5, 2012

(65) Prior Publication Data

US 2013/0224643 A1 Aug. 29, 2013

(30) Foreign Application Priority Data

Feb. 24, 2012 (JP) ..... 2012-038571

(51) Int. Cl.
*G03G 9/087* (2006.01)
*G03G 9/09* (2006.01)

(52) U.S. Cl.
USPC ..... 430/108.1; 430/108.6

(58) Field of Classification Search
USPC ..... 430/108.1, 108.6
See application file for complete search history.

(56) References Cited

U.S. PATENT DOCUMENTS

| | | | | |
|---|---|---|---|---|
| 5,135,832 | A | 8/1992 | Sacripante et al. | |
| 5,240,814 | A | 8/1993 | Held | |
| 2009/0214972 | A1 | 8/2009 | Wosnick et al. | |
| 2009/0243467 | A1 * | 10/2009 | Shimizu et al. | 313/503 |
| 2010/0075241 | A1 | 3/2010 | Kazmaier et al. | |
| 2011/0143274 | A1 * | 6/2011 | Iftime et al. | 430/108.2 |
| 2012/0167666 | A1 | 7/2012 | Nair et al. | |
| 2013/0071782 | A1 * | 3/2013 | Takamiya et al. | 430/105 |

FOREIGN PATENT DOCUMENTS

| | | | | |
|---|---|---|---|---|
| JP | A-2002-3835 | | 1/2002 | |
| JP | 2006233052 | * | 9/2006 | C09K 11/81 |
| JP | A-2007-17719 | | 1/2007 | |
| JP | A-2008-287239 | | 11/2008 | |
| JP | A-2009-205157 | | 9/2009 | |

OTHER PUBLICATIONS

Machine English language translation of JP 2006233052 Sep. 2006.*
U.S. Appl. No. 13/368,729 in the name of Takamiya et al., filed Feb. 8, 2012.
Sep. 4, 2013 Office Action issued in U.S. Appl. No. 13/368,729.

* cited by examiner

*Primary Examiner* — Hoa V Le
(74) *Attorney, Agent, or Firm* — Oliff PLC

(57) ABSTRACT

A transparent electrostatic charge image developing toner contains a binder resin, europium, and bismuth.

11 Claims, 3 Drawing Sheets

TRANSPARENT ELECTROSTATIC CHARGE IMAGE DEVELOPING TONER AND METHOD OF MANUFACTURING THE SAME, ELECTROSTATIC CHARGE IMAGE DEVELOPER, TONER CARTRIDGE, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2012-038571 filed Feb. 24, 2012.

BACKGROUND

1. Technical Field

The present invention relates to a transparent electrostatic charge image developing toner and a method of manufacturing the transparent electrostatic charge image developing toner, an electrostatic charge image developer, a toner cartridge, an image forming method, and an image forming apparatus.

2. Related Art

Currently, various fields use a method of visualizing image information through an electrostatic charge image using electrophotography or the like.

In the related electrophotography, a method of performing visualization through plural processes of: forming an electrostatic latent image on a photoreceptor or an electrostatic recording member using various sections; developing the electrostatic latent image (toner image) by adhering voltage-detection particles that are referred to as a toner to the electrostatic latent image; transferring the toner image onto a surface of a transfer member; and fixing the toner image by heating or the like is generally used.

In recent years, a toner that emits light using ultraviolet light has been reported.

SUMMARY

According to an aspect of the invention, there is provided a transparent electrostatic charge image developing toner containing a binder resin, europium, and bismuth.

BRIEF DESCRIPTION OF THE DRAWINGS

Exemplary embodiments of the present invention will be described in detail based on the following figures, wherein.

DETAILED DESCRIPTION

Electrostatic Charge Image Developing Toner

Figure 1:
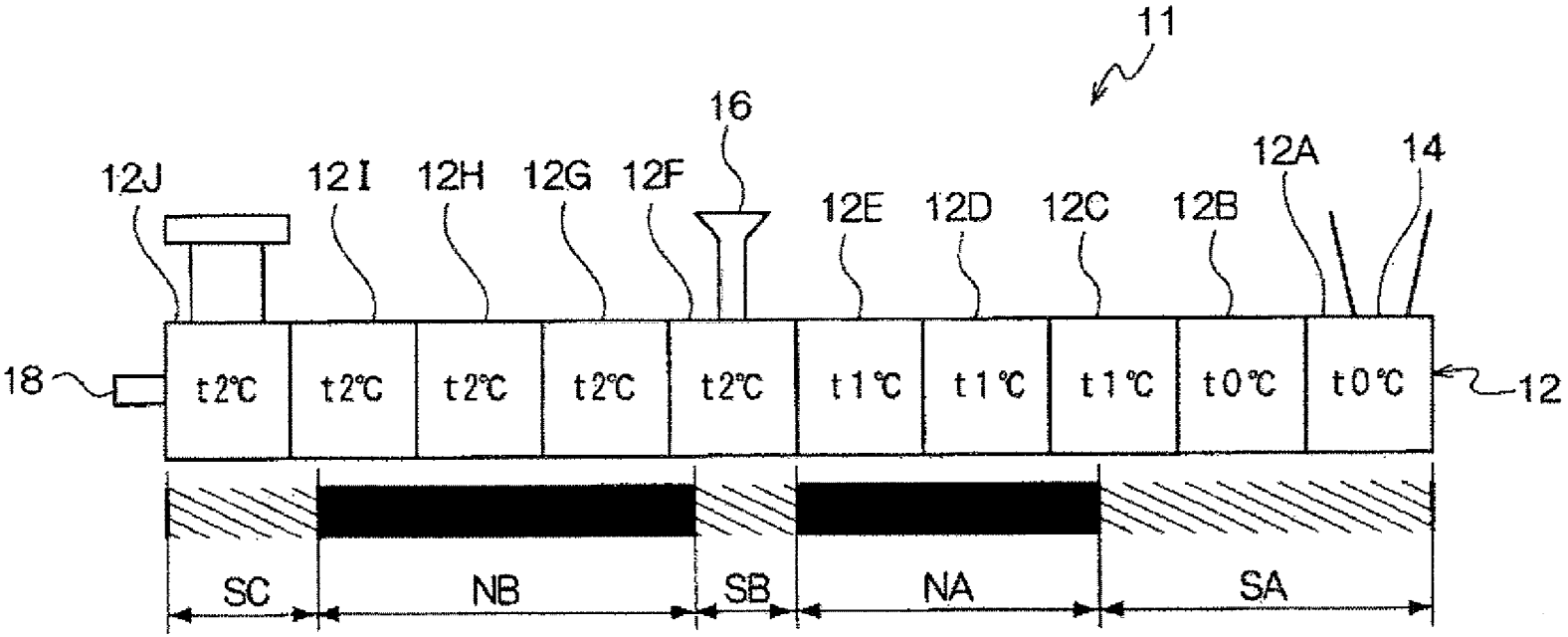
FIG. 1 is a diagram illustrating a screw state of an example of a screw extruder that is desirably used in manufacturing of an electrostatic charge image developing toner of an exemplary embodiment.

A transparent electrostatic charge image developing toner (hereinafter, also simply referred to as "toner" or "transparent toner") of this exemplary embodiment contains a binder resin, and further contains (A) europium and (B) bismuth.

In this exemplary embodiment, "transparent electrostatic charge image developing toner" means that, regardless of the color of the toner itself, an obtained image is transparent in a visible light range. That is, the toner itself may be tinged with white, or slightly tinged with yellow, blue or the like, but an image after fixing is transparent in a visible light range (wavelength of about 400 nm to about 800 nm). "Transparent in a visible light range" means that the transmittance of light in a visible light range is 10% or greater, and the transmittance is more preferably 75% or greater. It is desirable that the transmittance is measured with an image that is the same as that in the measurement of light emission luminance in examples. The transparent toner of this exemplary embodiment means a toner that does not contain a colored colorant (color pigment, color dye, black carbon particles, black magnetic powder, and the like) designed for coloring due to visible light absorption and visible light scattering, or a toner that contains a very small amount of a colored colorant so that coloring due to visible light absorption and visible light scattering is not perceived by the naked eye. Accordingly, it is desirable that the transparent electrostatic charge image developing toner of this exemplary embodiment is a transparent toner having no color although transparency may be slightly reduced in accordance with the types, amounts, and the like of the various components contained in the toner.

The inventors of the invention have made intensive studies, and as a result, have found that an electrostatic charge image developing toner that is excellent in smoothness of an obtained image and has high light emission luminance with respect to ultraviolet rays, that is, a toner that has high image confidentiality is obtained when the toner contains a particular element, thereby completing the invention.

The mechanism of the phenomenon is not necessarily clear, but the following mechanism is assumed to take place. That is, europium is a mineral having relatively high hardness. Bismuth is a metal having a lower melting point than other metals, and it is thought that when bismuth is added, the heat quantity necessary for fixing is reduced for the toner as a whole, and an image having high surface smoothness is obtained without raising the fixing temperature.

In addition, bismuth is a metal having a unique crystal structure, and has a property of reflecting particular wavelengths of light (visible light) due to the distance between atoms. Therefore, since bismuth reflects the visible light that is emitted from europium under ultraviolet irradiation, and the luminance is amplified, it is thought that sufficient light emission luminance is obtained even when the layer is thin (even when TMA is low).

Hereinafter, the components of the toner will be described in detail.

(A) Europium and (B) Bismuth

It is necessary for the toner of this exemplary embodiment to contain (A) europium (hereinafter, also referred to as element A) and (B) bismuth (hereinafter, also referred to as element B).

When the content of the element A in the toner that is measured using X-ray fluorescence analysis is represented by A (% by weight), A is preferably from 0.2% by weight to 7.0% by weight. Since high light emission luminance is obtained with respect to ultraviolet irradiation, it is desirable that a content A of the element A in the toner is 0.2% by weight or greater. In addition, when the content A is 7.0% by weight or less, the toner is easily formed, and thus offset at high temperature derived from unevenness in composition or the like may be suppressed. In addition, when the content A is greater than 7.0% by weight, the color may change.

The content A is more preferably from 0.5% by weight to 1.5% by weight, and even more preferably from 0.6% by weight to 1.2% by weight. When the content A is in the above range, the ink has higher light emission luminance with respect to ultraviolet irradiation. Furthermore, since the toner is more easily formed, it is more favorable in the above-described offset at high temperature.

When the content of the element B in the toner that is measured using X-ray fluorescence analysis is represented by B (% by weight), B is preferably from 0.02% by weight to 0.7% by weight. Since the smoothness of an obtained image is excellent, it is desirable that a content B of the element B in the toner is 0.02% by weight or greater. In addition, since the toner is easily formed and offset at high temperature derived from unevenness in composition or the like, may thus be suppressed, it is desirable that the content B is 0.7% by weight or less.

The content B is more preferably from 0.04% by weight to 0.4% by weight, and even more preferably from 0.06% by weight to 0.2% by weight. When the content B is in the above range, an obtained image has more excellent smoothness. Furthermore, since the toner is more easily formed, it is more favorable in the above-described offset at high temperature.

When the content of the element A in the toner that is measured by X-ray fluorescence analysis is represented by A (% by weight) and the content of the element B in the toner is represented by B (% by weight), the ratio A/B is preferably from 3 to 20. Since the smoothness of an obtained image is more excellent and higher light emission luminance is obtained with respect to ultraviolet irradiation, it is desirable that A/B is in the above range.

A/B is more preferably from 4 to 15, and even more preferably from 5 to 11.

Here, the content A (% by weight) of the element A in the toner that is obtained by X-ray fluorescence analysis and the content B (% by weight) of the element B in the toner are measured using the following method. Using a scanning X-ray fluorescence spectrometer (Rigaku ZSX Primus II), a disk having a toner amount of 0.130 g is molded, and under the conditions of an X-ray output of 40 mA to 70 mA, a measurement area of 10 mmϕ, and a measurement time of 15 minutes, measurement is performed using a qualitative and quantitative total elemental analysis method. The analysis values of EuLα and BiLα of the data are set as element amounts of this exemplary embodiment. When the peak overlaps with a peak of another element, ICP emission spectrometry or atomic absorption spectrometry is used for analysis, and then analysis values of the europium content and the bismuth content are obtained.

When the toner of this exemplary embodiment contains the element A and the element B, the form of the containment is not particularly limited. However, it is desirable that a complex including the element A and the element B is contained.

It is desirable that the complex is a complex in which an activated oxide with an element A set as an emission center (activator) is coactivated with an element B (bismuth). The activated oxide with an element A set as an activator is an oxide in which a crystalline oxide matrix is activated with an element A. The crystalline oxide matrix is not particularly limited if it is chemically stable. Examples of a crystalline oxide matrix include oxides and complex oxides of barium (Ba) calcium (Ca), magnesium (Mg), strontium (Sr), silicon (Si), boron (B), phosphorus (P), aluminum (Al), gallium (Ga), iron (Fe), copper (Cu), silver (Ag), nickel (Ni), palladium (Pd) cobalt (Co), tin (Sn), molybdenum (Mo), tungsten (W), zirconium (Zr), hafnium (Hf), zinc (Zn), titanium (Ti), manganese (Mn), vanadium (V), niobium (Nb), tantalum (Ta), antimony (Sb), bismuth (Bi), scandium (Sc), yttrium (Y), indium (In), lanthanum (La), and rare-earth elements.

The element A with which the crystalline oxide matrix is activated corresponds to emission center ions, and is preferably substituted in the range of from 1.0 atm % to 20.0 atm % with respect to the total number of metallic ions in the crystalline oxide matrix. When the content of the element A is in the above range, sufficient luminance efficiency is obtained. The above range is more preferably from 3.0 atm % to 10.0 atm %, and even more preferably from 5.0 atm % to 8.0 atm %.

The complex including the element A and the element B is not particularly limited. Examples thereof include $Y_2O_3$:A,B, $Y(P_x,V_{1-x})O_4$:A,B ($0 \leq x < 1$), $Y_2O_2S$:A,B, $Y_2SiO_5$:A,B, $Y_3Al_5O_{12}$:A,B, $YBO_3$:A,B, $Y_xGd_yBO_3$:A,B ($x+y=1$), $GdBO_3$:A,B, $ScBO_3$: A, B, $LuBO_3$: A, B, and $LaPO_4$:A, B. The symbol A represents europium, and the symbol B represents bismuth.

Among them, $Y_2O_3$:A,B or $Y(P_x,V_{1-x})O_4$:A,B are preferably used, and a complex that is expressed by the following Formula 1 is particularly preferably used.

$YVO_4$:A,B Formula 1

The method of manufacturing the complex including the element A and the element B is not particularly limited. A dry method may be used for synthesis, or a wet method may be used for synthesis.

Hereinafter, a dry manufacturing method will be described with $Y_2O_3$:Eu,Bi as an example. Raw material powders of $Y_2O_3$, $Eu_2O_3$, and $Bi_2O_3$ are weighed to predetermined amounts, respectively, to obtain a predetermined composition, and then these are sufficiently mixed using a ball mill or the like with an appropriate fusing agent such as $BaF_2$. When the raw material mixture is put into an alumina crucible and baked for about 1 to 6 hours at a temperature of 1,000° C. to 1,600° C. in the atmosphere, a fluorescent material of the yttrium oxide coactivated with $Eu^{3+}$ and $Bi^{3+}$ may be obtained.

In addition, a wet manufacturing method will be described with $YVO_4$:A,B as an example. As an example thereof, there is a method in which a first solution is formed by dissolving an yttrium compound and a compound including the element A with a complex-forming compound in the presence of water, and a second solution or dispersion is formed by dissolving or dispersing a vanadium compound in water to mix and react the first solution with the second solution or dispersion. For example, refer to Pamphlet WO2008/093845.

In addition, as an example of the wet manufacturing method for $Y_2O_3$:A,B, there is a method in which an yttrium compound, a compound including the element A, and a compound including the element B are reacted in the presence of a solvent such as alcohols and monomethyl ethers thereof and a particle diameter adjuster such as polyvinyl alcohol. For example, refer to JP-A-2008-189762.

Examples of a complex including europium and bismuth include $Y_2O_3$:Eu,Bi, $YVO_4$:Eu,Bi, and $Y_2O_2S$:Eu,Bi. Among them, $Y_2O_3$:Eu,Bi and $YVO_4$:Eu,Bi are preferably used, and $YVO_4$:$Eu^{3+}$,$Bi^{3+}$ is more preferably used.

The volume average particle diameter of particles formed of a complex including the element A and the element B (hereinafter, also referred to as "complex powder" or "complex particles") is preferably from 5 nm to 2,000 nm, more preferably from 5 nm to 1,000 nm, and even more preferably from 5 nm to 500 nm.

Since excellent dispersibility in the toner is obtained and the particle surface area increases, and thus the luminous efficiency increases, it is desirable that the volume average particle diameter of the complex powder is in the above range.

In addition, when the total amount of the particles formed of a complex including the element A and the element B increases, the fixability deteriorates in some cases. Specifically, since the particles formed of a complex including the element A and the element B are not easily involved in the strength of fixing, offset occurs in some cases in a high-temperature region, and this tendency is strengthened when the total amount of europium and bismuth is greater than 1.0%.

(C) Tin and/or Titanium

It is desirable that the electrostatic charge image developing toner of this exemplary embodiment contains (C) tin and/or titanium (hereinafter, also referred to as element C) in addition to the above-described (A) europium and (B) bismuth. The luminous efficiency of the europium complex is improved when tin and/or titanium is contained in the toner.

While europium emits light using ultraviolet light, the binder resin (preferably, polyester resin) of the toner also has a functional group (carbon-carbon double bond, carbon-oxygen double bond and the like) absorbing light in an ultraviolet region, and thus the binder resin has a property of absorbing ultraviolet light. Therefore, the polyester resin accounting for a large amount in the toner composition absorbs ultraviolet light, and thus fluorescence emission of the europium complex using ultraviolet light is decreased. Accordingly, when tin and/or titanium is contained in the polyester resin, the ultraviolet light absorption of the polyester resin spreads, and thus the europium complex efficiently absorbs ultraviolet light, and the luminous efficiency of the fluorescence thus increases.

When the europium content in the toner that is measured by X-ray fluorescence analysis is represented by A (% by weight), and the content of the element C in the toner cross-section that is observed using transmission electron microscope energy dispersive X-ray analysis is represented by C (% by weight), The ratio A/C is preferably from 3 to 20. When A/C is in the above range, the element C is uniformly dispersed in the resin, and absorption of the ultraviolet light by the resin is effectively inhibited.

The ratio A/C is more preferably from 3.5 to 15, and even more preferably from 4 to 11.

When tin and titanium are contained as the element C, the content of the element C means the total content of tin and titanium.

A content C (% by weight) of the element C in the toner that is obtained by transmission microscope energy dispersive X-ray analysis is measured by the following method. The toner is embedded in an epoxy resin, frozen using a cryostat, and cut into a thin film. Using a transmission electron microscope-energy dispersive X-ray analysis (TEM-EDX), the thin film is observed under the conditions of an accelerating voltage of 10 kV and an integrated time of 30 minutes. From the obtained toner cross-section observation photography (at a magnification of 10,000 times), the amount of the element C is analyzed using an image analyzer.

The element C may be contained as any compound in the toner. However, when a polyester resin is used as a binder resin to be described later, the element C is desirably added as a catalyst in a case of synthesizing the polyester resin.

Examples of a tin-containing compound that is desirable as a catalyst include tin formate, tin oxalate, tetraphenyl tin, dibutyltin dichloride, dibutyltin oxide, diphenyltin oxide, dioctyltin oxide, and monobutyltin oxide, and examples of a titanium-containing compound include titanium tetraethoxide, titanium tetrapropoxide, titanium tetraisopropoxide, and titanium tetrabutoxide.

Binder Resin

The toner contains a binder resin.

It is desirable that a polyester resin is used as the binder resin in this exemplary embodiment. Since a polyester resin is hydrophilic, it is dispersed well in forming of the toner, and the europium complex may be taken in toner base particles in a more uniform state. Therefore, a polyester resin is preferably used.

Desirable examples of a polycondensation resin include a polyester resin and a polyamide resin, and particularly, a polyester resin that is obtained using a material containing a polycarboxylic acid and polyol as a polycondensable monomer, is preferably used.

Examples of a polycondensable monomer that may be used in this exemplary embodiment include polyvalent carboxylic acids, polyols, hydroxycarboxylic acids, polyamines, and mixtures thereof. Particularly, as a polycondensable monomer, polyvalent carboxylic acids, polyols, and ester compounds thereof (oligomer and/or prepolymer) are preferably used, and a polyester resin may be obtained through a direct ester reaction or an ester exchange reaction. In this case, a polyester resin to be polymerized may have any form such as an amorphous polyester resin (non-crystalline polyester resin), a crystalline polyester resin, or a mixed form thereof may be employed.

In this exemplary embodiment, the polycondensation resin is obtained by polycondensing at least one type that is selected from the group consisting of polycondensable monomers and oligomers and prepolymers thereof. Among them, polycondensable monomers are preferably used.

The polyvalent carboxylic acid is a compound containing two or more carboxyl groups in a molecule. Among polycarboxylic acids, dicarboxylic acid is a compound containing two carboxyl groups in a molecule, and examples thereof include oxalic acid, succinic acid, glutaric acid, maleic acid, adipic acid, β-methyl adipic acid, azelaic acid, sebacic acid, nonanedicarboxylic acid, decanedicarboxylic acid, undecanedicarboxylic acid, dodecanedicarboxylic acid, fumaric acid, citraconic acid, diglycol acid, cyclohexane-3,5-diene-1,2-carboxylic acid, hexahydroterephthalic acid, malonic acid, pimelic acid, suberic acid, phthalic acid, isophthalic acid, terephthalic acid, tetrachlorophthalic acid, chlorophthalic acid, nitrophthalic acid, p-carboxyphenylacetic acid, p-phenylene diacerate, m-phenylene diacerate, o-phenylene diacerate, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid.

In addition, examples of polyvalent carboxylic acids other than dicarboxylic acids include trimellitic acid, trimesic acid, pyromellitic acid, naphthalene tricarboxylic acid, naphthalene tetracarboxylic acid, pyrenetricarboxylic acid, pyrenetetracarboxylic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, and lower esters thereof, as well as acid halides and acid anhydrides.

These may be used singly or in a combination of two or more types.

The lower esters are esters in which the alkoxy portion of the ester has carbon atoms of from 1 to 8. Specific examples thereof include methyl esters, ethyl esters, n-propyl esters, isopropyl esters, n-butyl esters, and isobutyl esters.

The polyol is a compound containing two or more hydroxyl groups in a molecule. Among polyols, a diol is a compound containing two hydroxyl groups in a molecule, and specific examples of a diol include ethylene glycol, diethylene glycol, triethylene glycol, 1,2-propylene glycol, 1,3-propylene glycol, 1,4-butanediol, 1,5-pentanediol, 1,6-hexanediol, 1,8-octanediol, 1,9-nonanediol, 1,7-heptanediol, 1,11-undecanediol, 1,12-dodecanediol, 1,10-decanediol, 1,13-tridecanediol, 1,14-tetradecanediol, 1,18-octadecanediol, 1,14-eicosanedecanediol, dipropylene glycol, polyethylene glycol, polypropylene glycol, polytetramethylene ether glycol, 1,4-cyclohexanediol, 1,4-cyclohexanedimethanol, 1,4-butenediol, neopentyl glycol, polytetramethylene glycol, hydrogenated bisphenol-A, bisphenol-A, bisphenol-F, bisphenol-S, and alkylene oxide (ethylene oxide, propylene oxide, butylene oxide, and the like) adducts of the above bisphenols. Among them, alkylene glycol with carbon atoms of from 2 to 12 and alkylene oxide adducts of bisphenols are preferably used, and particularly, alkylene oxide adducts of bisphenols and combinations of alkylene glycol with carbon atoms of from 2 to 12 with the alkylene oxide adducts of bisphenols are preferably used.

In addition, examples of a material for higher water dispersibility include 2,2-dimethylol propionic acid, 2,2-dimethylol butanoic acid, and 2,2-dimethylol valeric acid.

Examples of tri- or higher-valent alcohols include glycerin, trimethylolethane, trimethylol propane, pentaerythritol, hexamethylol melamine, hexaethylol melamine, tetramethylol benzoguanamine, tetraethylol benzoguanamine, sorbitol, trisphenol PA, phenol novolac, cresol novolac, and alkylene oxide adducts of the tri- or higher-valent polyphenols. These may be used singly or in a combination of two or more types.

In addition, an amorphous resin and a crystalline resin may be easily obtained by combination of the polycondensable monomers.

When a crystalline polyester resin is used as the binder resin, examples of polyesters include polyester that is obtained by reacting 1,9-nonanediol with 1,10-decanedicarboxylic acid, or reacting cyclohexanediol with an adipic acid, polyester that is obtained by reacting 1,6-hexanediol with sebacic acid, polyester that is obtained by reacting ethylene glycol with succinic acid, polyester that is obtained by reacting ethylene glycol with sebacic acid, and polyester that is obtained by reacting 1,4-butanediol with succinic acid. Among them, polyester that is obtained by reacting 1,9-nonanediol with 1,10-decanedicarboxylic acid, polyester that is obtained by reacting 1,6-hexanediol with sebacic acid, and the like are particularly preferably used, but the examples are not limited thereto.

In addition, hydroxycarboxylic acid may also be used. Specific examples of the hydroxycarboxylic acid include hydroxyheptanoic acid, hydroxyoctanoic acid, hydroxydecanoic acid, hydroxyundecanoic acid, malic acid, tartaric acid, mucic acid, and citric acid.

In addition, examples of polyamine include ethylenediamine, diethylenediamine, 1,2-propanediamine, 1,3-propanediamine, 1,4-butanediamine, 1,4-butenediamine, 2,2-dimethyl-1,3-butanediamine, 1,5-pentanediamine, 1,6-hexanediamine, 1,4-cyclohexanediamine, 1,4-cyclohexanebis(methylamine), and the like.

In addition, the weight average molecular weight of the polycondensation resin that is obtained by polycondensation of a polycondensable monomer is preferably from 1,500 to 40,000, and more preferably from 3,000 to 30,000. Since the binder resin has favorable cohesive force and an excellent hot offset property, it is desirable that the weight average molecular weight is 1,500 or greater, and since an excellent offset property is obtained and an excellent minimum fixing temperature is shown, it is desirable that the weight average molecular weight is 40,000 or less. In addition, partial branching, cross-linking and the like may be provided by selection in carboxylic acid valence of the monomer and alcohol valence.

In addition, the acid value of the obtained polyester resin is preferably from 1 mg·KOH/g to 50 mg·KOH/g. A first reason is that the toner particle diameter and the distribution in an aqueous medium are required to be controlled for practical use as a high-image quality toner, and when the acid value is 1 mg·KOH/g or greater, a sufficient particle diameter and distribution may be achieved in the granulation process. Furthermore, a sufficient electrification property may be obtained when the polyester resin is used in the toner. When the acid value of polyester to be polycondensed is 50 mg·KOH/g or less, a sufficient molecular weight for obtaining image quality strength for the toner may be obtained in the polycondensation. In addition, the dependence of the electrification property of the toner on environment at high humidity is also reduced and excellent image reliability is obtained.

When an amorphous polyester resin is used, the glass transition temperature Tg of the amorphous polyester resin is preferably from 50° C. to 80° C., and more preferably from 50° C. to 65° C. When Tg is 50° C. or higher, the binder resin itself in a high-temperature region has excellent cohesive force, and thus the hot offset property is excellent in the fixing. In addition, when. Tg is 80° C. or lower, melting is carried out sufficiently and the minimum fixing temperature does not rise easily.

The glass transition temperature of the binder resin is a value measured using a method (DSC method) specified in ASTM D3418-82.

Examples of an addition polymerizable monomer that is used in the preparation of an addition polymerization-type resin include a cationic polymerizable monomer and a radical polymerizable monomer, and a radical polymerizable monomer is preferably used.

Examples of a radical polymerizable monomer include styrene-based monomers, unsaturated carboxylic acids, (meth)acrylates ("(meth)acrylates" means acrylate and methacrylate, and has the same usage below), N-vinyl compounds, vinyl esters, halogenated vinyl compounds, N-substituted unsaturated amides, conjugated dienes, multifunctional vinyl compounds, and multifunctional (meth)acrylates. Among them, N-substituted unsaturated amides, conjugated dienes, multifunctional vinyl compounds and multifunctional (meth) acrylates and the like may cause a cross-linking reaction to the generated polymer. These may be used singly or in combination.

Examples of an addition polymerizable monomer that may be used in this exemplary embodiment include a radical polymerizable monomer, a cationic polymerizable monomer and an anionic polymerizable monomer, and a radical polymerizable monomer is preferably used.

As a radical polymerizable monomer, a compound having an ethylenic unsaturated bond is preferably used, and an aromatic ethylenic unsaturated compound (hereinafter, also referred to as "vinyl aromatic"), a carboxylic acid (unsaturated carboxylic acid) having an ethylenic unsaturated bond, a derivative of an unsaturated carboxylic acid, such as ester, aldehyde, nitrile or amide, a N-vinyl compound, vinyl esters, a halogenated vinyl compound, a N-substituted unsaturated amide, conjugated diene, a multifunctional vinyl compound, or multifunctional (meth)acrylate is more preferably used.

Specific examples thereof include unsubstituted vinyl aromatics such as styrene and p-vinylpyridine, vinyl aromatics such as α-substituted styrenes such as α-methylstyrene and α-ethylstyrene, aromatic nucleus-substituted styrenes such as m-methylstyrene, p-methylstyrene and 2,5-dimethylstyrene, and aromatic-nucleus halogen-substituted styrenes such as p-chlorostyrene, p-bromostyrene and dibromostyrene, unsaturated carboxylic acids such as (meth)acrylic acid ("(meth)acryl" means acryl and methacryl, and has the same usage below), crotonic acid, maleic acid, fumaric acid, citraconic acid and itaconic acid, unsaturated carboxylic acid esters such as methyl (meth)acrylate, ethyl (meth)acrylate, propyl (meth)acrylate, butyl (meth)acrylate, pentyl (meth) acrylate, hexyl (meth)acrylate, 2-ethylhexyl (meth)acrylate, glysidyl (meth)acrylate and benzyl (meth)acrylate, unsaturated carboxylic acid derivatives such as (meth)acrylic aldehyde, (meth)acrylonitrile and (meth)acrylamide, N-vinyl compounds such as N-vinylpyridine and N-vinylpyrrolidone, vinyl esters such as vinyl formate, vinyl acetate and vinyl propionate, halogenated vinyl compounds such as vinyl chloride, vinyl bromide and vinylidene chloride, N-substituted unsaturated amides such as N-methylolacrylamide, N-ethylolacrylamide, N-propanolacrylamide, N-methylolmaleinamide acid, N-methylolmaleinamide acid ester, N-methylolmaleimide and N-ethylolmaleimide, conjugated dienes such as butadiene and isoprene, multifunctional vinyl compounds such as divinylbenzene, divinylnaphthalene, and divinylcyclohexane, and multifunctional acrylates such as ethylene glycol di(meth)acrylate, diethylene glycol di(meth)acrylate, propylene glycol di(meth)acrylate, tetramethylene glycol di(meth)acrylate, neopentyl glycol di(meth)acrylate, hexamethylene glycol di(meth)acrylate, trimethylol propane di(meth)acrylate, trimethylol propane tri(meth)acrylate, glycerol di(meth)acrylate, glycerol tri(meth)acrylate, pentaerythritol di(meth)acrylate, pentaerythritol tri(meth)acrylate, pentaerythritol tetra(meth)acrylate, dipentaerythritol di(meth)acrylate, dipentaerythritol tri(meth)acrylate, dipentaerythritol tetra(meth)acrylate, dipentaerythritol penta (meth)acrylate, dipentaerythritol hexa(meth)acrylate, sorbitol tri(meth)acrylate, sorbitol tetra(meth)acrylate, sorbitol penta(meth)acrylate and sorbitol hexa(meth)acrylate. In addition, a sulfonic acid and a phosphoric acid having an ethylenic unsaturated bond, and derivatives thereof may also be used. Among them, N-substituted unsaturated amides, conjugated dienes, multifunctional vinyl compounds, multifunctional acrylates and the like may cause a cross-linking reaction to the generated polymer. The addition polymerizable monomers may be used singly or in a combination of two or more types.

In addition, the content of the binder resin in the toner of this exemplary embodiment is preferably from 10% by weight to 90% by weight with respect to the total weight of the toner, more preferably from 30% by weight to 85% by weight, and even more preferably from 50% by weight to 80% by weight.

Release Agent

It is desirable that the electrostatic charge image developing toner of this exemplary embodiment contains a release agent.

It is desirable that, for example, ester wax, polyethylene, polypropylene, or a copolymer of polyethylene and polypropylene is used as a release agent, and specific examples thereof include waxes such as polyglycerin wax, microcrystalline wax, paraffin wax, carnauba wax, Sasol wax, montanic acid ester wax and deoxidized carnauba wax; unsaturated fatty acids such as palmitic acid, stearic acid, montanic acid, brassidic acid, eleostearic acid and parinaric acid; saturated alcohols such as stearyl alcohol, aralkyl alcohol, behenyl alcohol, carnaubyl alcohol, ceryl alcohol, melissyl alcohol and long-chain alkyl alcohols having a long-chain alkyl group; polyhydric alcohols such as sorbitol; fatty acid amides such as linoleic acid amide, oleic acid amide and lauric acid amide; saturated fatty acid bisamides such as methylenebisstearic acid amide, ethylenebiscapric acid amide, ethylenebislauric acid amide and hexamethylenebisstearic acid amide; unsaturated fatty acid amides such as ethylenebisoleic acid amide, hexamethylenebisoleic acid amide, N,N'-dioleyladipic acid amide and N,N'-dioleylcebasic acid amide; aromatic bisamides such as m-xylenebisstearic acid amide and N,N'-distearylisophthalic acid amide; fatty acid metal salts (generally so-called metal soaps) such as calcium stearate, calcium laurate, zinc stearate and magnesium stearate; waxes grafted to aliphatic hydrocarbon-based wax using a vinyl-based monomer such as styrene and an acrylic acid; partially esterified products of a fatty acid and polyhydric alcohol such as behenic acid monoglyceride; and methyl ester compounds having a hydroxyl group that is obtained by hydrogenating vegetable oil.

The release agent may be used singly or in a combination of two or more types. The release agent is preferably contained in the range of from 1% by weight to 20% by weight with respect to 100% by weight of the binder resin, and more preferably in the range of from 3% by weight to 15% by weight. When the content is in the above range, excellent fixing and image quality characteristics may be balanced.

Other Components

If necessary, various components, such as an internal additive, a charge-controlling agent, an inorganic powder (inorganic particles) and organic particles, other than the above-described components may be added to the toner.

Examples of an internal additive include magnetic materials, such as metals such as ferrite, magnetite, reduced iron, cobalt, nickel and manganese, alloys and compounds containing the metals. When the toner contains the magnetic material and the like and is used as a magnetic toner, the average particle diameter of the ferromagnetic materials is preferably 2 μm or less, and more preferably from about 0.1 μm to about 0.5 μm. The amount contained in the toner is preferably from 20 parts by weight to 200 parts by weight with respect to 100 parts by weight of the resin component, and particularly preferably from 40 parts by weight to 150 parts by weight with respect to 100 parts by weight of the resin component. In addition, regarding the magnetic characteristics when 10 KOe is applied, it is desirable that the coercive force (Hc) is from 20 Oe to 300 Oe, the saturated magnetization (σs) is from 50 emu/g to 200 emu/g, and the remnant magnetization (σr) is from 2 emu/g to 20 emu/g.

Examples of a charge-controlling agent include tetrafluorine-based surfactants, salicylic acid metal complexes, metal complex dyes such as an azo-based metal compound, polymer acids such as a polymer containing a maleic acid as a monomer component, quaternary ammonium salts, and azine-based dyes such as nigrosine.

External Additive

It is desirable that an external additive is externally added to a surface of the toner. Examples of an external additive that is externally added to the surface include inorganic particles and organic particles. Specifically, the following examples and the external additive that is used in a toner manufacturing method to be described later are also included.

Examples of inorganic particles include silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, and silicon nitride.

Generally, inorganic particles are used for the purpose of improving fluidity. The primary particle diameter of the inorganic particles is preferably from 1 nm to 200 nm, and the amount added is preferably from 0.01 part by weight to 20 parts by weight with respect to 100 parts by weight of the toner.

Generally, organic particles are used for the purpose of improving cleanability and transferability, and specific examples thereof include fluorine-based resin powders such as polyvinylidene fluoride and polytetrafluoroethylene, fatty acid metal salts such as zinc stearate and calcium stearate, polystyrene, and polymethylmethacrylate.

In this exemplary embodiment, it is preferable that an external additive having a number average primary particle diameter of 18 nm or less or 25 nm or greater is contained as the external additive. In addition, it is preferable that an external additive having a number average primary particle diameter that is greater than 18 nm and less than 25 nm is not contained as the external additive.

The reason for this is not clear, but is likely as follows. When an external additive having a number average primary particle diameter that is greater than 18 nm and less than 25 nm is contained as the external additive, blue light is absorbed and the light emission luminance of the toner is reduced under ultraviolet irradiation.

The number average primary particle diameter of the external additive is obtained as follows. External additive particles are diluted using ethanol and dried on a carbon grid for a transmission electron microscope (TEM: JEM-1010, manufactured by JEOL Ltd.) to perform TEM observation (at a magnification of 50,000 times). The image of TEM observation is printed, and 50 primary particle samples are arbitrarily extracted. The outer diameter of circular particles corresponding to the area of the image (average value of the major axis and the minor axis: obtained with approximation to a circle) is set as the number average particle diameter of the external additive.

Among the above-described external additives, inorganic oxides such as titania and silica are preferably used from the viewpoint of improvement in fluidity and charging characteristics.

The amount of the external additive added is preferably from 0.1 part by weight to 5 parts by weight with respect to 100 parts by weight of the toner particles before external addition. When the amount externally added is 0.1 part by weight or greater, an improvement in fluidity and electrification property due to the external additive is shown. When the amount externally added is 5 parts by weight or less, a sufficient electrification property is provided.

Toner Properties

It is desirable that the toner of this exemplary embodiment has ultraviolet absorptivity. In addition, it is desirable that the toner of this exemplary embodiment absorbs ultraviolet rays and emits fluorescence.

The wavelength of the ultraviolet rays that are absorbed by the toner depends on a europium compound added, and is not particularly limited. Generally, the wavelength is from 300 nm to 400 nm. The wavelength is preferably from 320 nm to 390 nm, and more preferably from 340 nm to 380 nm.

In addition, the light emission luminance of an image is measured as follows. Using the toner of this exemplary embodiment, a Japan color standard printing patch for sheet-fed printing and a copied image of the patch are subjected to spectral fluorescence measurement using a fluorescence spectrophotometer. The evaluation is performed by light-emission peak intensity.

A volume average particle diameter Dv ($D_{50v}$) of the toner of this exemplary embodiment is preferably from 2 μm to 20 μm, more preferably from 3 μm to 15 μm, and even more preferably from 4 μm to 10 μm.

In addition, a volume average particle diameter Dv ($D_{50v}$) of the toner base particles in the toner of this exemplary embodiment is preferably from 2 μm to 20 μm, more preferably from 3 μm to 15 μm, and even more preferably from 4 μm to 10 μm.

It is desirable that the particle size distribution of the toner is narrow. More specifically, the value (GSDp) of the square root of the ratio of the 84% diameter ($D_{84p}$) to the 16% diameter ($D_{16p}$) converted from the smallest number diameter side of the toner, that is, GSDp that is expressed by the following formula is preferably 1.40 or less, more preferably 1.31 or less, and particularly preferably 1.27 or less.

In addition, GSDp is even more preferably 1.15 or greater.

$$GSDp=\{(D_{84p})/(D_{16p})\}^{0.5}$$

When both of the volume average particle diameter and GSDp are in the above ranges, respectively, excessively small particles are not present, and thus a reduction in developability due to an excessive charge amount of the small particle-diameter toner may be suppressed.

In the measurement of the average particle diameter of toner particles, a Coulter Multisizer II (manufactured by Beckman Coulter, Inc.) may be used. In this case, the measurement may be performed using an optimum aperture depending on the particle diameter level of the particles. The measured particle diameter of the particles is expressed by the volume average particle diameter.

When the particle diameter of the particles is about 5 μm or less, the measurement may be performed using a laser diffraction/scattering particle size distribution measuring device (LA-700, manufactured by Horiba, Ltd.).

Furthermore, when the particle diameter is a nanometer-order diameter, the measurement may be performed using a BET specific surface measuring device (Flow Sorb II 2300, manufactured by Shimadzu Corporation).

In this exemplary embodiment, a shape factor SF1 of the toner is preferably from 110 to 145, and more preferably from 120 to 140.

The shape factor SF1 is a shape factor showing the degree of unevenness of the particle surface, and is calculated using the following expression.

$$SF1 = \frac{(ML)^2}{A} \times \frac{\pi}{4} \times 100$$

In the expression, ML represents the maximum length of the particle, and A represents a projected area of the particle.

As a specific method of measuring the shape factor SF1, for example, first, an optical microscopic image of the toner sprayed on a glass slide is scanned to an image analyzer through a video camera, the shape factors SF1 of 50 toner particles are calculated, and an average value thereof is obtained.

Toner Preparation Method

The toner manufacturing method of this exemplary embodiment is not particularly limited. Toner particles are prepared using a dry method such as a known kneading pulverization method or a wet method such as an emulsion aggregation method or a suspension polymerization method, and if necessary, an external additive is externally added to the toner particles. Among the methods, a kneading pulverization method is preferably used.

The kneading pulverization method is a method including: kneading a toner forming material containing a binder resin to obtain a kneaded material; and pulverizing the kneaded material to prepare the toner particles. When the toner particles are prepared using the kneading pulverization method to obtain the toner, the complex powder is dispersed well, and the smoothness of an image and light emission luminance are improved.

More specifically, the kneading pulverization method is divided into a kneading process of kneading a toner forming material that contains a binder resin and a compound containing europium and bismuth and a pulverization process of pulverizing the kneaded material. If necessary, the kneading pulverization method may have other processes such as a cooling process of cooling the kneaded material formed by the kneading process.

For example, the method may include kneading a toner forming material that contains a binder resin and a compound containing europium and bismuth, cooling the kneaded material formed by the kneading, pulverizing the kneaded material cooled by the cooling, and classifying the kneaded material pulverized by the pulverizing.

Each process will be described in detail.

Kneading Process

The kneading process is a process of kneading a toner forming material that contains a binder resin and a compound containing europium and bismuth.

In the kneading process, it is desirable that from 0.5 part by weight to 5 parts by weight of an aqueous medium (for example, water such as distilled water or ion exchange water, alcohols or the like) is added with respect to 100 parts by weight of a toner forming material.

Examples of a kneader that is used in the kneading process include a single-screw extruder and a twin-screw extruder. Hereinafter, as an example of the kneader, a kneader having a sending screw portion and two kneading portions will be described using a diagram, but the example of the kneader is not limited thereto.

FIG. 1 is a diagram illustrating a screw state of an example of a screw extruder that is used in the kneading process of the toner manufacturing method of this exemplary embodiment.

A screw extruder 11 is constituted by a barrel 12 provided with a screw (not shown), an injection port 14 through which a toner forming material that is a raw material of the toner is injected to the barrel 12, a liquid addition port 16 for adding an aqueous medium to the toner forming material in the barrel 12, and a discharge port 18 through which the kneaded material formed by kneading the toner forming material in the barrel 12 is discharged.

The barrel 12 is divided into, in order of distance from the injection port 14, a sending screw portion SA that transports the toner forming material injected from the injection port 14 to a kneading portion NA, the kneading portion NA for melting and kneading the toner forming material by a first kneading process, a sending screw portion SB that transports the toner forming material melted and kneaded in the kneading portion NA to a kneading portion NB, the kneading portion NB that melts and kneads the toner forming material by a second kneading process to form the kneaded material, and a sending screw portion. SC that transports the formed kneaded material to the discharge port 18.

In addition, in the barrel 12, a different temperature controller (not shown) is provided for each block. That is, the temperatures of blocks 12A to 12J may be controlled to be different from each other. FIG. 1 shows a state in which the temperatures of the blocks 12A and 12B are controlled to t0° C., the temperatures of the blocks 12C to 12E are controlled to t1° C., and the temperatures of the blocks 12F to 12J are controlled to t2° C. Therefore, the toner forming material in the kneading portion NA is heated to t1° C., and the toner forming material in the kneading portion NB is heated to t2° C.

When a toner forming material that contains a binder resin, a compound containing europium and bismuth, and if necessary, a release agent and the like is supplied to the barrel 12 from the injection port 14, the toner forming material is sent to the kneading portion NA by the sending screw portion SA. At this time, since the temperature of the block 12C is set to t1° C., the toner forming material melted by heating is fed to the kneading portion NA. In addition, since the temperatures of the blocks 12D and 12E are also set to t1° C., the toner forming material is melted and kneaded at a temperature of t1° C. in the kneading portion NA. The binder resin and the release agent are melted in the kneading portion NA and shorn by the screw.

Next, the toner forming material kneaded in the kneading portion NA is sent to the kneading portion NB by the sending screw portion SB.

In the sending screw portion SB, an aqueous medium is added to the toner forming material by injecting the aqueous medium to the barrel 12 from the liquid addition port 16. In addition, in FIG. 1, the aqueous medium is injected in the sending screw portion SB, but the invention is not limited thereto. The aqueous medium may be injected in the kneading portion NB, or may be injected in both of the sending screw portion SB and the kneading portion NB. That is, the position at which the aqueous medium is injected and the number of injection positions are selected as necessary.

As described above, due to the injection of the aqueous medium to the barrel 12 from the liquid addition port 16, the toner forming material in the barrel 12 and the aqueous medium are mixed, and the toner forming material is cooled by evaporative latent heat of the aqueous medium, whereby the temperature of the toner forming material is properly maintained.

Finally, the kneaded material formed by melting and kneading of the kneading portion NB is transported to the discharge port 18 by the sending screw portion SC, and is discharged from the discharge port 18.

As described above, the kneading process using the screw extruder 11 shown in FIG. 1 is performed.

Cooling Process

The cooling process is a process of cooling the kneaded material that is formed in the kneading process, and in the cooling process, it is desirable that the kneaded material is cooled to 40° C. or lower from the temperature of the kneaded material upon the end of the kneading process at an average temperature decrease rate of 4° C./sec or higher. When the cooling rate of the kneaded material is low, the mixture (mixture with an internal additive such as a release agent to be internally added into toner particles as necessary) finely dispersed in the binder resin in the kneading process is recrystallized and the dispersion diameter increases in some cases. Since the dispersion state immediately after the end of the kneading process is maintained as it is, it is desirable that the kneaded material is rapidly cooled at the average temperature decrease rate. The average temperature decrease rate is an average value of the rate at which the temperature is decreased to 40° C. from the temperature of the kneaded material upon the end of the kneading process (for example, t2° C. when the screw extruder 11 of FIG. 1 is used).

Specific examples of a cooling method in the cooling process include a method using a mill roll in which cold water or brine is circulated, an insertion-type cooling belt and the like. When the cooling is performed using the above-described method, the cooling rate is determined by the speed of the mill roll, the flow rate of the brine, the supply amount of the kneaded material, the slab thickness at the time of rolling of the kneaded material, and the like. The slab thickness is preferably from 1 mm to 3 mm.

Pulverization Process

The kneaded material cooled by the cooling process is pulverized using the pulverization process to form toner particles. In the pulverization process, for example, a mechanical pulverizer, a jet mill or the like is used.

Classification Process

If necessary, the toner particles obtained by the pulverization process may be classified by a classification process in order to obtain toner particles having a volume average particle diameter in a target range. In the classification process, a centrifugal classifier, an inertia-type classifier or the like that has been used in the past is used, and fine particles (toner particles having a particle diameter smaller than the target range) and coarse particles (toner particles having a particle diameter larger than the target range) are removed.

External Addition Process

For the purpose of adjusting the charging, addition of fluidity, addition of charge exchangeability, and the like, the above-described inorganic particles typified by particular silica, titania and aluminum oxide may be added and adhered to the obtained toner particles. This is performed by, for example, a V-shaped blender, a Henschel mixer, a Loedige mixer or the like, and the adhesion is performed in stages.

Sieving Process

If necessary, a sieving process may be provided after the above-described external addition process. Specifically, as a sieving method, for example, a gyro shifter, a vibration sieving machine, a wind classifier or the like is used. Through sieving, coarse particles of the external additive and the like are removed, and thus the generation of stripes and trickling down contamination are suppressed.

Electrostatic Charge Image Developer

An electrostatic charge image developer of this exemplary embodiment (hereinafter, may be referred to as "developer") is not particularly limited provided it contains the above-described toner of this exemplary embodiment. The electrostatic charge image developer may be a single-component developer using a toner alone, or a two-component developer containing a toner and a carrier. When the electrostatic charge image developer is a single-component developer, it may be a toner containing magnetic metallic particles or a nonmagnetic single-component toner not containing magnetic metallic particles.

The carrier is not particularly limited if it is a known carrier, and an iron powder-based carrier, a ferrite-based carrier, a surface-coated ferrite carrier or the like is used. In addition, respective surface additional powders may be used after being subjected to a desired surface treatment.

Specific examples of the carrier include carriers coated with the following resins. Examples of core particles of the carrier include a normal iron powder, ferrite, and granulated magnetite, and the volume average particle diameter thereof is preferably from 30 μm to 200 μm.

In addition, examples of the coating resin of the resin-coated carrier include homopolymers or copolymers made of two or more types of monomers of styrenes such as styrene, parachlorostyrene and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acryls such as dimethylaminoethyl methacrylate; vinyl nitriles such as acrylonitrile and methacrylonitrile; vinyl pyridines such as 2-vinylpyridine and 4-vinylpyridine; vinyl ethers such as vinyl methyl ether and vinyl isobutyl ether; vinyl ketones such as vinyl methyl ketone, vinyl ethyl ketone and vinyl isopropenyl ketone; olefins such as ethylene and propylene; fluorine-containing vinyl-based monomers such as vinylidene fluoride, tetrafluoroethylene and hexafluoroethylene, as well as silicone resins including methyl silicone and methylphenyl silicone, polyesters including bisphenol and glycol, epoxy resins, polyurethane resins, polyamide resins, cellulose resins, polyether resins, and polycarbonate resins. These resins may be used singly or in a combination of two or more types. The amount of the coating resin is preferably from about 0.1 part by weight to about 10 parts by weight with respect to 100 parts by weight of the core particles, and more preferably from 0.5 part by weight to 3.0 parts by weight.

The carrier is manufactured using, for example, a heating kneader, a heating Henschel mixer, a UM mixer, or the like. Depending on the amount of the coating resin, a heating fluidized bed, a heating kiln or the like is used.

Since excellent resistance controllability is obtained even when a thick coated layer is formed, and thus excellent image quality and image quality maintainability are obtained, it is desirable that as the carrier, a carrier that is formed by coating ferrite particles as a core with a resin in which carbon black as an electroconductive agent and/or melamine beads as a charge-controlling agent are dispersed in methyl acrylate or ethyl acrylate and styrene is used.

The mixing ratio of the toner and the carrier in the developer is not particularly limited and is selected in accordance with the purpose.

Image Forming Apparatus

Next, an image forming apparatus using the electrostatic charge image developing toner of this exemplary embodiment will be described.

An image forming apparatus of this exemplary embodiment has an image holding member, a charging unit that charges a surface of the image holding member, an exposure unit that exposes the charged image holding member to form an electrostatic latent image on a surface of the image holding member, a developing unit that develops the electrostatic latent image with a developer including a toner to form a toner image, a transfer unit that transfers the toner image onto a surface of a transfer member from the image holding member, and a fixing unit that fixes the toner image transferred onto the surface of the transfer member, and the developer is the electrostatic charge image developing toner of this exemplary embodiment, or the electrostatic charge image developer of this exemplary embodiment.

In addition, the image forming apparatus has a cleaning unit (toner removing unit) that scrapes the image holding member with a cleaning member to remove the residual components left after transferring, and uses the electrostatic charge image developer of this exemplary embodiment as the developer.

In the image forming apparatus, for example, a portion including the developing unit may be provided to have a cartridge structure (process cartridge) that is detachably mounted on an image forming apparatus body. As the process cartridge, a process cartridge of this exemplary embodiment, that is provided with at least a developer holding member and accommodates the electrostatic charge image developer of this exemplary embodiment, is desirably used.

Hereinafter, an example of the image forming apparatus of this exemplary embodiment will be described. However, the invention is not limited thereto. Major portions shown in the drawing will be described, and descriptions of other portions will be omitted.

Figure 2:
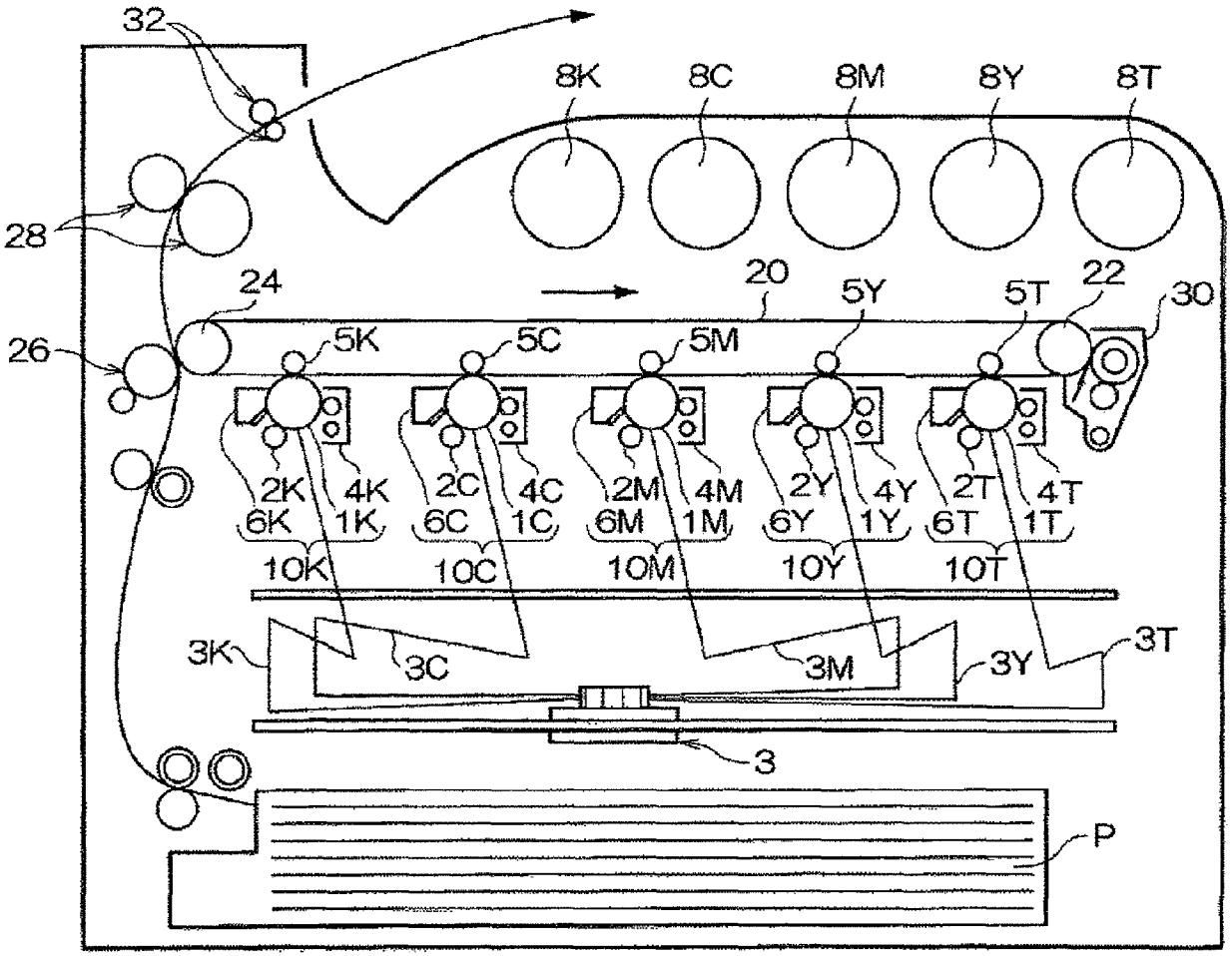
FIG. 2 is a schematic diagram showing the configuration of an example of an image forming apparatus that is desirably used in the exemplary embodiment.

FIG. 2 is a schematic diagram showing the configuration of a 5-drum tandem full-color image forming apparatus. The image forming apparatus shown in FIG. 2 is provided with first to fifth electrophotographic image forming units 10Y, 10M, 10C, 10K, and 10T (image forming units) that output a transparent (colorless) (T) image, a yellow (Y) image, a magenta (M) image, a cyan (C) image, and a black (K) image, respectively, based on color-separated image data. The image forming units (hereinafter, simply referred to as "unit") 10T, 10Y, 10M, 10C and 10K are arranged in a horizontal direction at a distance from each other. The units 10T, 10Y, 10M, 10C and 10K each may be a process cartridge that is detachably mounted on the image forming apparatus body.

An intermediate transfer belt 20 as an intermediate transfer member is disposed above the units 10T, 10Y, 10M, 10C, and 10K in the drawing to extend via the units. The intermediate transfer belt 20 is wound on a driving roller 22 and a support roller 24 contacting the inner surface of the intermediate transfer belt 20, which are separated from each other on the left and right sides in the drawing, and travels in the direction toward the fifth unit 10K from the first unit 10T. The support roller 24 is impelled in the direction in which it departs from the driving roller 22 by a spring or the like (not shown), and a tension is given to the intermediate transfer belt 20 wound on both of the rollers. In addition, an intermediate transfer member cleaning device 30 opposed to the driving roller 22 is provided on a surface of the intermediate transfer belt 20 on the image holding member side.

Developing devices (developing units) 4T, 4Y, 4M, 4C and 4K of the units 10T, 10Y, 10M, 10C and 10K are supplied with five toners, that is, a transparent toner, a yellow toner, a magenta toner, a cyan toner, and a black toner accommodated in toner cartridges 8T, 8Y, 8M, 8C and 8K, respectively.

The above-described first to fifth units 10T, 10Y, 10M, 10C, and 10K have the same configuration. Accordingly, only the first unit 10T that is disposed on the upstream side in the traveling direction of the intermediate transfer belt to form a transparent image will be representatively described. The same portions as in the first unit 10T will be denoted by the reference numerals with yellow (Y), magenta (M), cyan (C), and black (K) added instead of transparent (T), and descriptions of the second to fifth units 10Y, 10M, 10C, and 10K will be omitted.

The first unit 10T has a photoreceptor 1T acting as an image holding member. Around the photoreceptor 1T, a charging roller 2T that charges a surface of the photoreceptor 1T, an exposure device 3 that exposes the charged surface with laser beams 3T based on a color-separated image signal to form an electrostatic latent image, a developing device (developing unit) 4T that supplies a charged toner to the electrostatic latent image to develop the electrostatic latent image, a primary transfer roller (primary transfer unit) 5T that transfers the developed toner image onto the intermediate transfer belt 20, and a photoreceptor cleaning device (cleaning unit) 6T that removes the toner remaining on the surface of the photoreceptor 1T after primary transferring, are arranged in sequence.

The primary transfer roller 5T is disposed inside the intermediate transfer belt 20 to be provided at a position opposed to the photoreceptor 1T. Furthermore, bias supplies (not shown) that apply a primary transfer bias are connected to the primary transfer rollers 5T, 5Y, 5M, 5C, and 5K, respectively. The bias supplies change the transfer bias that is applied to each primary transfer roller under the control of a controller (not shown).

Hereinafter, the operation of forming a transparent image in the first unit 10T will be described. First, before the operation, the surface of the photoreceptor 1T is charged to a potential of from about −600 V to about −800 V by the charging roller 2T.

The photoreceptor 1T is formed by stacking a photosensitive layer on a conductive base (volume resistivity at 20° C.: $1\times10^{-6}\Omega$ cm or less). This photosensitive layer typically has high resistance (resistance that is about the same as the resistance of a general resin), but has a property that, when laser beams 3T are applied thereto, the specific resistance of a portion irradiated with the laser beams changes. Accordingly, the laser beams 3T are output to the surface of the charged photoreceptor 1T via the exposure device 3 in accordance with image data for transparency sent from the controller (not shown). The laser beams 3T are applied to the photosensitive layer on the surface of the photoreceptor 1T, whereby an electrostatic latent image of a transparent print pattern is formed on the surface of the photoreceptor 1T.

The electrostatic latent image is an image that is formed on the surface of the photoreceptor 1T by charging, and is a so-called negative latent image, that is formed by applying the laser beams 3T to the photosensitive layer so that the specific resistance of the irradiated portion is lowered to cause charges to flow on the surface of the photoreceptor 1T and to cause charges to stay on a portion to which the laser beams 3T are not applied.

The electrostatic latent image that is formed in this manner on the photoreceptor 1T is rotated up to a development position with the travelling of the photoreceptor 1T. The electrostatic latent image on the photoreceptor 1T is developed at the development position by the developing device 4T.

In the developing device 4T, a transparent toner of this exemplary embodiment is accommodated. The transparent toner is frictionally charged by being stirred in the developing device 4T to have a charge with the same polarity (negative polarity) as the charge that is on the photoreceptor 1T, and is thus held on the developer roll (developer holding member). By allowing the surface of the photoreceptor 1T to pass through the developing device 4T, the transparent toner is electrostatically adhered to a latent image portion having substantially no charge on the surface of the photoreceptor 1T, whereby the latent image is developed with the transparent toner. Next, the photoreceptor 1T having a transparent toner image formed thereon travels and the developed toner image on the photoreceptor 1T is transported to a primary transfer position.

When the transparent toner image on the photoreceptor 1T is transported to the primary transfer position, a primary transfer bias is applied to the primary transfer roller 5T and an electrostatic force toward the primary transfer roller 5T from the photoreceptor 1T acts on the toner image, whereby the toner image on the photoreceptor 1T is transferred onto the intermediate transfer belt 20. The transfer bias applied at this time has the opposite polarity (+) of the toner polarity (−), and is controlled to, for example, about +10 μA in the first unit 10T by the controller (not shown).

On the other hand, the toner remaining on the photoreceptor 1T is removed and collected by the photoreceptor cleaning device 6T.

The primary transfer biases that are applied to the primary transfer rollers 5Y, 5M, 5C, and 5K of the second unit 10Y and the subsequent units are also controlled in the same manner as in the case of the first unit.

In this manner, the intermediate transfer belt 20 onto which the transparent toner image is transferred in the first unit 10T is sequentially transported through the second to fifth units 10Y, 10M, 10C, and 10K, and the toner images of respective colors are transferred in a superimposed manner.

The intermediate transfer belt 20 onto which five color toner images have been transferred through the first to fifth units reaches a secondary transfer portion which includes the intermediate transfer belt 20, the support roller 24 contacting the inner surface of the intermediate transfer belt 20, and a secondary transfer roller (secondary transfer unit) 26 disposed on the image holding surface side of the intermediate transfer belt 20. Meanwhile, a recording sheet (transfer member) P is supplied to a gap between the secondary transfer roller 26 and the intermediate transfer belt 20, which are pressed against each other, using a supply mechanism, and a secondary transfer bias is applied to the support roller 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer portion, and is voltage-controlled.

Thereafter, the recording sheet P is fed to the fixing device (fixing unit) 28, the toner image is heated, and the color-superimposed toner image is melted and fixed onto the recording sheet P. The recording sheet P on which the fixing of the color image is completed is transported toward the discharge portion, and a series of the color image forming operations ends.

The image forming apparatus exemplified as above has a configuration in which the toner image is transferred onto the recording sheet P via the intermediate transfer belt 20. However, the invention is not limited to this configuration, and may have a structure in which the toner image may be transferred directly onto the recording sheet from the photoreceptor.

Process Cartridge and Toner Cartridge

Figure 3:
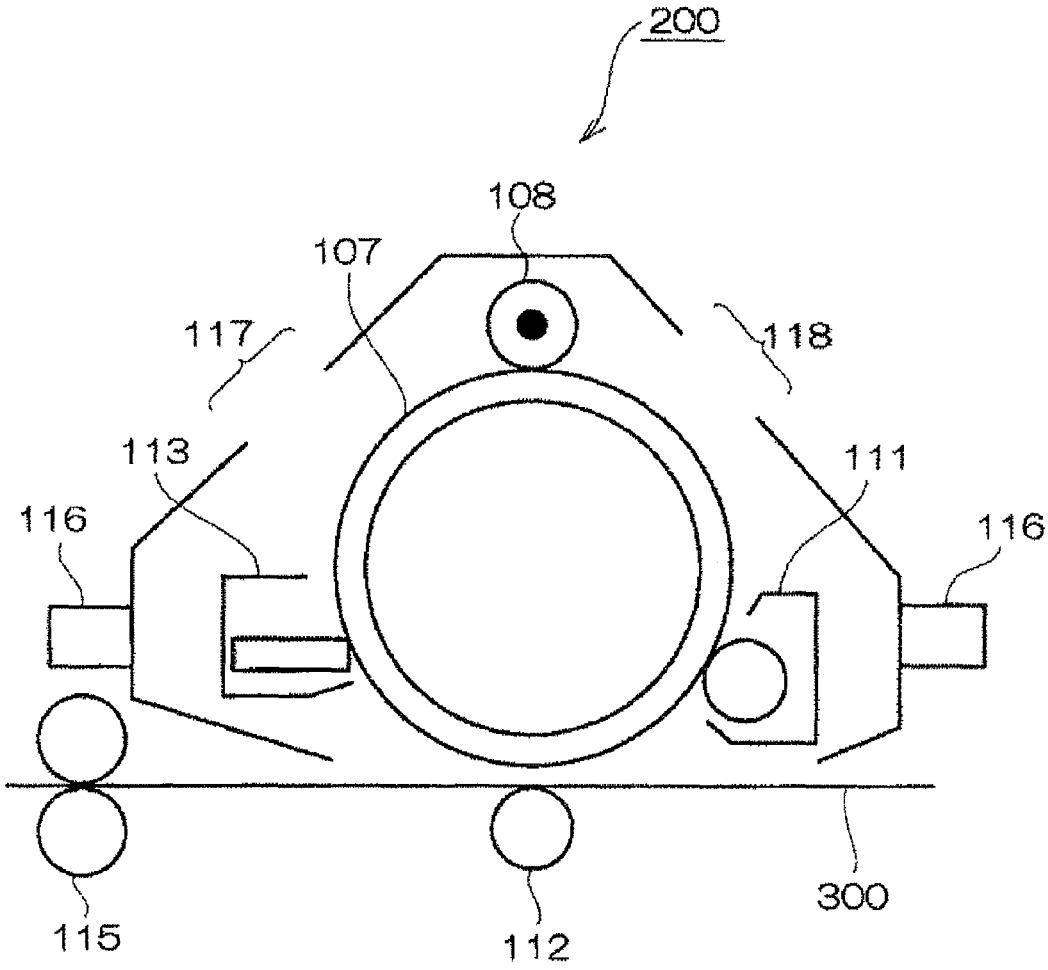
FIG. 3 is a schematic diagram showing the configuration of a process cartridge that is desirably used in the exemplary embodiment.

FIG. 3 is a schematic diagram showing the configuration of a desirable example of a process cartridge that accommodates the electrostatic charge image developer of this exemplary embodiment. A process cartridge 200 has, in addition to a photoreceptor 107, a charging roller 108, a developing device 111 provided with a developer holding member 111A, a photoreceptor cleaning device (cleaning unit) 113, an opening portion 118 for exposure, and an opening portion 117 for erasing exposure, and they are combined and integrated using an attachment rail 116.

The process cartridge 200 is detachably mounted on an image forming apparatus body including a transfer device 112, a fixing device 115, and other constituent portions (not shown), and constitutes, together with the image forming apparatus body, an image forming apparatus that forms an image on a recording sheet 300.

The process cartridge shown in FIG. 3 includes the charging roller 108, the developing device 111, the cleaning device (cleaning unit) 113, the opening portion 118 for exposure, and the opening portion 117 for erasing exposure, but these devices may be selectively combined. The process cartridge of this exemplary embodiment may include at least the developing device 111 provided with the developer holding member 111A and may include at least one selected from the group consisting of the photoreceptor 107, the charging device 108, the cleaning device (cleaning unit) 113, the opening portion 118 for exposure, and the opening portion 117 for erasing exposure.

Next, a toner cartridge of this exemplary embodiment will be described. The toner cartridge is detachably mounted on an image forming apparatus, and at least, in the toner cartridge that stores a toner to be supplied to a developing unit provided in the image forming apparatus, the toner is the above-described toner of this exemplary embodiment. The toner cartridge of this exemplary embodiment may accommodate at least a toner, and depending on the mechanism of the image forming apparatus, may accommodate, for example, a developer.

Accordingly, in an image forming apparatus having a configuration in which a toner cartridge is detachably mounted, a toner cartridge that stores the toner of this exemplary embodiment is used to easily supply the toner of this exemplary embodiment to a developing device.

The image forming apparatus shown in FIG. 2 is an image forming apparatus that has a configuration in which the toner cartridges 8T, 8Y, 8M, 8C, and 8K are detachably mounted. The developing devices 4T, 4Y, 4M, 4C, and 4K are connected to the toner cartridges corresponding to the respective developing devices (colors) via toner supply tubes (not shown). In addition, when the toner stored in the toner cartridge runs low, the toner cartridge may be replaced.

Image Forming Method

Next, an image forming method using the toner of this exemplary embodiment will be described. The toner of this exemplary embodiment is used in a known image forming method using an electrophotographic system. Specifically, the toner is used in an image forming method having the following processes.

That is, a desirable image forming method includes: a latent image forming process of forming an electrostatic latent image on a surface of an image holding member; a developing process of developing the electrostatic latent image formed on the surface of the image holding member with a developer including a toner to form a toner image; a transfer process of transferring the toner image onto a surface of a transfer member; and a fixing process of fixing the toner image transferred onto the surface of the transfer member, and uses the electrostatic charge image developing toner of this exemplary embodiment, or the electrostatic charge image developer of this exemplary embodiment as the developer. In addition, in the transfer process, an intermediate transfer member that mediates the transfer of the toner image onto the transfer member from the electrostatic latent image holding member may be used.

Examples

Hereinafter, this exemplary embodiment will be described in more detail using examples and comparative examples, but is not limited to the examples.

In the following examples, unless specifically noted, "parts" represents "parts by weight" and "%" represents "% by weight".

Measurement Method

Element Analysis

The contents of the element A and the element B in the toner may be measured using the following method. That is, using a scanning X-ray fluorescence spectrometer (Rigaku ZSX Primus II), a disk having a toner amount of 0.130 g is molded, and under the conditions of an X-ray output of 40 mA to 70 mA, a measurement area of 10 mmϕ, and a measurement time of 15 minutes, measurement is performed using a qualitative and quantitative total elemental analysis method. The analysis values of EuLα and BiLα of the data are set as element amounts of this exemplary embodiment. When the peak overlaps with a peak of another element, ICP emission spectrometry or atomic absorption spectrometry are used for analysis, and then analysis values of the europium content and the bismuth content may be obtained.

In addition, regarding Sn and Ti, measurement is performed by energy dispersive X-ray analysis. The toner is embedded in an epoxy resin, frozen using a cryostat, and cut into a thin film. Using a transmission electron microscope-energy dispersive X-ray analysis (TEM-EDX), the thin film is observed under the conditions of an accelerating voltage of 10 kV and an integrated time of 30 minutes. From the obtained toner cross-section observation photography (at a magnification of 10,000 times), the analysis value of an image analyzer is set as an element amount.

Method of Measuring Volume Average Particle Diameter of Carrier and Volume Average Particle Diameter of Toner The volume average particle diameter of a carrier is measured using an electronic microscope (SEM). Specifically, an image is obtained by SEM, and then a particle diameter (maximum length portion) $r_1$ is measured for each particle. 100 particle diameters are measured, and then $r_1$ to $r_{100}$ are expressed in terms of spherical diameter to obtain volumes, and the value corresponding to 50% from the first volume to the one-hundred-th volume is set as the volume average particle diameter.

The volume average particle diameter of a toner is measured using a Coulter Multisizer II (manufactured by Beckman Coulter, Inc.). ISOTON-II (manufactured by Beckman Coulter, Inc.) is used as an electrolyte.

As a measurement method, first, from 0.5 mg to 50 mg of a measurement sample is added to 2 ml of a surfactant as a dispersant, preferably a 5% aqueous solution of sodium alkylbenzene sulfonate. The resultant material is added to from 100 ml to 150 ml of the electrolyte. The electrolyte in which the measurement sample is suspended is subjected to a dispersion treatment for about 1 minute by an ultrasonic dispersing machine, and the particle size distribution of particles having a particle diameter of from 2.0 μm to 60 μm is measured by the Coulter Multisizer II with the use of an aperture having an aperture diameter of 100 μm. The number of particles to be measured is 50,000.

The measured particle size distribution is accumulated to draw a cumulative distribution from the smallest diameter side for the weight or volume relative to divided particle size ranges (channels), and the particle diameter corresponding to 50% in accumulation is defined as a weight average particle diameter or a volume average particle diameter.

Synthesis of Complex Powder A 40 parts of an ethanol solution (solution A) containing 0.5 part of vanadium oxide acetylacetonate is obtained. After nitrogen substitution of the solution A, heating is initiated and the temperature is maintained at 90° C. 40 parts of an ethanol solution (solution B) containing 1 part of yttrium acetylacetonate trihydrate and 0.09 part of europium oxalate hexahydrate is prepared and added to the solution A. After stirring for 15 minutes, 10 parts of a solution (solution C) in which 0.05 part of bismuth nitrate is dissolved in pure water is added dropwise to the solution A over 30 minutes. Stirring is performed while the temperature of the system is maintained at 90° C., and aging is performed for 5 hours. Then, the solvent is removed by distillation under reduced pressure. A powder obtained in this manner is vacuum-dried to obtain a complex powder A. The volume average particle diameter of the obtained complex powder A is 241 nm, and the powder is measured by X-ray fluorescence analysis, it is confirmed that the powder is a material including the elements europium, bismuth, and yttrium. The results are shown in Table 1.

Synthesis of Complex Powder B 40 parts of an ethanol solution (solution A) containing 0.8 part of yttrium oxide is obtained. After nitrogen substitution of the solution A, heating is initiated and the temperature is maintained at 85° C. 40 parts of an ethanol solution (solution B) containing 0.12 part of europium oxalate hexahydrate is prepared and added to the solution A. After stirring for 15 minutes, 10 parts of a solution (solution C) in which 0.08 part of bismuth nitrate is dissolved in pure water is added dropwise to the solution A over 30 minutes. Stirring is performed while the temperature of the system is maintained at 85° C., and aging is performed for 5 hours. Then, the solvent is removed by distillation under reduced pressure. A powder obtained in this manner is vacuum-dried to obtain a complex powder B. The volume average particle diameter of the obtained complex powder B is 299 nm, and the powder is measured by X-ray fluorescence analysis, it is confirmed that the powder is a material including the elements europium, bismuth, and yttrium. The results are shown in Table 1.

Synthesis of Complex Powder C

A complex powder C is obtained in the same manner as in the case of the complex powder B, except that the solution A is changed to 40 parts of an ethanol solution (solution A) containing 0.8 part of yttrium oxide and 1 part of acrylic acid/sulfonic acid monomer copolymer (AQUALICL GL, manufactured by Nippon Shokubai Co., Ltd.), the solution B and the solution C are added and aging is performed in the synthesis of the complex powder B. The volume average particle diameter of the obtained complex powder C is 309 nm, and when the powder is subjected to the measurement by X-ray fluorescence analysis, it is confirmed that the powder is a material including the elements europium, bismuth, yttrium, and sulfur. The results are shown in Table 1.

Synthesis of Complex Powder D

A complex powder D is obtained in the same manner as in the case of the complex powder A, except that the solution A is changed to 100 parts of an ethanol solution (solution A) containing 6.5 parts of vanadium oxide acetylacetonate and the solution B is changed to 100 parts of an ethanol solution containing 13 parts of yttrium acetylacetonate trihydrate and 1.2 parts of europium oxalate hexahydrate in the synthesis of the complex powder A. The volume average particle diameter of the obtained complex powder D is 256 nm, and when the powder is subjected to the measurement by X-ray fluorescence analysis, it is confirmed that the powder is a material including the elements europium, bismuth, yttrium. The results are shown in Table 1.

Synthesis of Complex Powder E

A complex powder E is obtained in the same manner as in the case of the complex powder A, except that the solution A is changed to 40 parts of an ethanol solution containing 0.09 part of vanadium oxide acetylacetonate and the solution B is changed to 40 parts of an ethanol solution containing 0.2 part of yttrium acetylacetonate trihydrate and 0.015 part of europium oxalate hexahydrate in the synthesis of the complex powder A. The volume average particle diameter of the obtained complex powder E is 235 nm, and when the powder is subjected to the measurement by X-ray fluorescence analysis, it is confirmed that the powder is a material including the elements europium, bismuth, and yttrium. The results are shown in Table 1.

Synthesis of Complex Powder F

A complex powder F is obtained in the same manner as in the case of the complex powder A, except that the solution A is changed to 60 parts of an ethanol solution (solution A) containing 3 parts of vanadium oxide acetylacetonate, the solution B is changed to 60 parts of an ethanol solution containing 6 parts of yttrium acetylacetonate trihydrate and 0.54 part of europium oxalate hexahydrate, and the solution C is changed to 30 parts of a solution (solution C) in which 0.4 part of bismuth nitrate is dissolved in pure water in the synthesis of the complex powder A. The volume average particle diameter of the obtained complex powder F is 288 nm, and when the powder is subjected to the measurement by X-ray fluorescence analysis, it is confirmed that the powder is a material including the elements europium, bismuth, and yttrium. The results are shown in Table 1.

Synthesis of Complex Powder G

A complex powder G is obtained in the same manner as in the case of the complex powder A, except that the solution A is changed to 40 parts of an ethanol solution containing 0.15 part of vanadium oxide acetylacetonate, the solution B is changed to 40 parts of an ethanol solution containing 0.4 part of yttrium acetylacetonate trihydrate and 0.03 part of europium oxalate hexahydrate, and the solution C is changed to 10 parts of a solution in which 0.5 part of bismuth nitrate is dissolved in pure water in the synthesis of the complex powder A. The volume average particle diameter of the obtained complex powder G is 354 nm, and when the powder is subjected to the measurement by X-ray fluorescence analysis, it is confirmed that the powder is a material including the elements europium, bismuth, and yttrium. The results are shown in Table 1.

Complex Powder H

A complex powder H is obtained in the same manner as in the case of the complex powder A, except that the solution A is changed to 40 parts of an ethanol solution containing 1 part of vanadium oxide acetylacetonate, the solution B is changed to 40 parts of an ethanol solution containing 2 parts of yttrium acetylacetonate trihydrate and 0.18 part of europium oxalate hexahydrate, and the solution C is changed to 10 parts of a solution in which 0.35 part of bismuth nitrate is dissolved in pure water in the synthesis of the complex powder A. The volume average particle diameter of the obtained complex powder H is 198 nm, and when the powder is subjected to the measurement by X-ray fluorescence analysis, it is confirmed that the powder is a material including the elements europium, bismuth, and yttrium. The results are shown in Table 1.

Complex Powder I

A complex powder I is obtained in the same manner as in the case of the complex powder A, except that the solution A is changed to 40 parts of an ethanol solution containing 0.3 part of vanadium oxide acetylacetonate, the solution B is changed to 40 parts of an ethanol solution containing 1.2 parts of yttrium acetylacetonate trihydrate and 0.045 part of europium oxalate hexahydrate, and the solution C is changed to 10 parts of a solution in which 0.35 part of bismuth nitrate is dissolved in pure water in the synthesis of the complex powder A. The volume average particle diameter of the obtained complex powder I is 276 nm, and when the powder is subjected to the measurement by X-ray fluorescence analysis, it is confirmed that the powder is a material including the elements europium, bismuth, and yttrium. The results are shown in Table 1.

Complex Powder J

A complex powder J is obtained in the same manner as in the case of the complex powder A, except that the solution. A is changed to 40 parts of an ethanol solution containing 1 part of vanadium oxide acetylacetonate and the solution B is changed to 40 parts of an ethanol solution containing 2 parts of yttrium acetylacetonate trihydrate and 0.18 part of europium oxalate hexahydrate in the synthesis of the complex powder A. The volume average particle diameter of the obtained complex powder J is 243 nm, and when the powder is subjected to the measurement by X-ray fluorescence analysis, it is confirmed that the powder is a material including the elements europium, bismuth, and yttrium. The results are shown in Table 1.

Complex Powder K

A complex powder K is obtained in the same manner as in the case of the complex powder A, except that the solution A is changed to 40 parts of an ethanol solution containing 0.8 part of vanadium oxide acetylacetonate, the solution B is changed to 40 parts of an ethanol solution containing 1.6 parts of yttrium acetylacetonate trihydrate and 0.15 part of europium oxalate hexahydrate, and the solution C is changed to 10 parts of a solution in which 0.1 part of bismuth nitrate is dissolved in pure water in the synthesis of the complex powder A. The volume average particle diameter of the obtained complex powder K is 232 nm, and when the powder is subjected to the measurement by X-ray fluorescence analysis, it is confirmed that the powder is a material including the elements europium, bismuth, and yttrium. The results are shown in Table 1.

Complex Powder L 40 parts of an ethanol solution (solution A) containing 0.7 part of vanadium oxide acetylacetonate is obtained. After nitrogen substitution of the solution A, heating is initiated and the temperature is maintained at 90° C. 40 ml of an ethanol solution (solution. B) containing 1.2 parts of yttrium acetylacetonate trihydrate and 0.12 parts of europium oxalate hexahydrate is prepared and added to the solution A. Stirring is performed while the temperature of the system is maintained at 90° C., and aging is performed for 5 hours. Then, the solvent is removed by distillation under reduced pressure. A powder obtained in this manner is vacuum-dried to obtain a complex powder L. The volume average particle diameter of the obtained complex powder L is 186 nm, and when the powder is subjected to the measurement by X-ray fluorescence analysis, it is confirmed that the powder is a material including the elements europium and yttrium. The results are shown in Table 1'.

Complex Powder M 40 parts of an ethanol solution (solution A) containing 0.8 part of vanadium oxide acetylacetonate is obtained. After nitrogen substitution of the solution A, heating is initiated and the temperature is maintained at 90° C. 40 parts of an ethanol solution (solution B) containing 1.3 parts of yttrium acetylacetonate trihydrate is prepared and added to the solution A. After stirring for 15 minutes, 10 parts of a solution (solution C) in which 0.09 part of bismuth nitrate is dissolved in pure water is added dropwise to the solution A over 30 minutes. Stirring is performed while the temperature of the system is maintained at 90° C., and aging is performed for 7 hours. Then, the solvent is removed by distillation under reduced pressure. A powder obtained in this manner is vacuum-dried to obtain a complex powder M. The volume average particle diameter of the obtained complex powder M is 205 nm, and when the powder is subjected to the measurement by X-ray fluorescence analysis, it is confirmed that the powder is a material including the elements bismuth and yttrium. The results are shown in Table 1.

TABLE 1

| | Complex Kind | Fluorescent X-ray Eu Amount A (% by weight) | Fluorescent X-ray Bi Amount B (% by weight) | Eu Amount/ Bi Amount (A/B) | Particle Diameter (nm) |
|---|---|---|---|---|---|
| Complex Powder A | $YVO_4$ | 13.2 | 2.42 | 5.5 | 241 |
| Complex Powder B | $Y_2O_3$ | 15.1 | 1.94 | 7.8 | 299 |
| Complex Powder C | $Y_2O_2S$ | 12.8 | 1.79 | 7.2 | 309 |
| Complex Powder D | $YVO_4$ | 49.6 | 6.02 | 8.2 | 256 |
| Complex Powder E | $YVO_4$ | 2.1 | 0.61 | 3.4 | 235 |
| Complex Powder F | $YVO_4$ | 38.7 | 8.51 | 4.5 | 288 |
| Complex Powder G | $YVO_4$ | 4.0 | 0.23 | 17.4 | 354 |
| Complex Powder H | $YVO_4$ | 26.3 | 1.24 | 21.2 | 198 |
| Complex Powder I | $YVO_4$ | 5.5 | 13.8 | 0.4 | 276 |
| Complex Powder J | $YVO_4$ | 23.5 | 1.76 | 13.4 | 243 |
| Complex Powder K | $YVO_4$ | 20.8 | 3.72 | 5.6 | 232 |
| Complex Powder L | $YVO_4$ | 21.8 | — | — | 186 |
| Complex Powder M | $YVO_4$ | — | 2.86 | — | 205 |

Preparation of Toner 1

Polyester Resin (polyester resin that is synthesized using a tin catalyst containing propylene oxide 2-mol adduct/ethylene oxide 2-mol adduct of bisphenol A, a terephthalic acid and a trimellitic acid as major components) 171 parts Release Agent (Polypropylene; manufactured by Mitsui Chemicals, Inc., Mitsui HI-WAX NP055): 5.0 parts Complex Powder A: 10.0 parts The above components are mixed using a Henschel mixer, and then kneading is carried out using a continuous kneader (twin-screw extruder) having the screw structure shown in FIG. 1 under the following conditions. The rotation rate of the screw is set to 500 rpm.

Preset Temperature of Feeding Portion (Blocks 12A and 12B): 20° C.

Preset Kneading Temperature (Blocks 12C to 12E) of Kneading Portion 1: 100° C.

Preset Kneading Temperature (Blocks 12F to 12J) of Kneading Portion 2: 110° C.

Amount of Aqueous Medium (distilled water) Added (with respect to 100 parts of Raw Material Supply Amount): 1.5 parts At this time, the temperature of the kneaded material in the discharge port (discharge port 18) is 120° C.

The kneaded material is rapidly cooled using a mill roll in which brine of −5° C. passes and a slab insertion-type cooling belt for cooling with cold water of 2° C. After cooling, crushing is performed using a hammer mill. The rapid cooling rate is confirmed by changing the speed of the cooling belt and the average temperature decrease rate is 10° C./sec.

Thereafter, pulverization is performed using a pulverizer with a built-in coarse particle classifier (AFG 400) to obtain pulverized particles. Then, classification is performed using an inertia-type classifier to remove fine particles and coarse particles, and thus toner particles 1 having a volume average particle diameter of 6.0 μm are obtained.

1.5 parts of a titanium compound (number average primary particle diameter 43 nm) that is treated with 40 parts of isobutyl trimethoxysilane with respect to 100 parts of a metatitanic acid and 1.2 parts of spherical silica that is treated with hexamethyldisilazane of 130 nm are added to the obtained toner particles and mixed for 10 minutes by a Henschel mixer (external addition blending). Then, by a wind classifier (hi-bolter), 45 μm-sieving is performed to obtain a toner 1. The results are shown in Table 2.

Preparation of Toner 2

Toner particles 2 having a volume average particle diameter of 7.4 μM are obtained in the same manner as in the case of the toner 1, except that the complex powder A is changed to the complex powder B in the preparation of the toner 1. The external addition and sieving processes are performed in the same manner as in the case of the toner particles 1 to obtain the toner 2. The results are shown in Table 2.

Preparation of Toner 3

Toner particles 3 having a volume average particle diameter of 5.8 μm are obtained in the same manner as in the case of the toner 1, except that the complex powder A is changed to the complex powder C in the preparation of the toner 1. The external addition and sieving processes are performed in the same manner as in the case of the toner particles 1 to obtain the toner 3. The results are shown in Table 2.

Preparation of Toner 4

Toner particles 4 having a volume average particle diameter of 6.2 μm are obtained in the same manner as in the case of the toner 1, except that the polyester resin is changed to a polyester resin (polyester resin that is synthesized by a titanium catalyst containing propylene oxide 2-mol adduct/ethylene oxide 2-mol adduct of bisphenol A, a terephthalic acid and a trimellitic acid as major components) in the preparation of the toner 1. The external addition and sieving processes are performed in the same manner as in the case of the toner particles 1 to obtain the toner 4. The results are shown in Table 2.

Preparation of Toner 5

Toner particles 5 having a volume average particle diameter of 4.8 μm are obtained in the same manner as in the case of the toner 1, except that the complex powder A is changed to the complex powder D, the amount of the complex powder D is 27 parts, and the amount of the polyester resin is 154 parts in the preparation of the toner 1. The external addition and sieving processes are performed in the same manner as in the case of the toner particles 1 to obtain the toner 5. The results are shown in Table 2.

Preparation of Toner 6

Toner particles 6 having a volume average particle diameter of 8.2 μm are obtained in the same manner as in the case of the toner 1, except that the complex powder A is changed to the complex powder E in the preparation of the toner 1. The external addition and sieving processes are performed in the same manner as in the case of the toner particles 1 to obtain the toner 6. The results are shown in Table 2.

Preparation of Toner 7

Toner particles 7 having a volume average particle diameter of 6.9 μm are obtained in the same manner as in the case of the toner 1, except that the complex powder A is changed to the complex powder F in the preparation of the toner 1. The external addition and sieving processes are performed in the same manner as in the case of the toner particles 1 to obtain the toner 7. The results are shown in Table 2.

Preparation of Toner 8

Toner particles 8 having a volume average particle diameter of 3.9 μm are obtained in the same manner as in the case of the toner 1, except that the complex powder A is changed to the complex powder G in the preparation of the toner 1. The external addition and sieving processes are performed in the same manner as in the case of the toner particles 1 to obtain the toner 8. The results are shown in Table 2.

Preparation of Toner 9

Toner particles 9 having a volume average particle diameter of 9.5 μm are obtained in the same manner as in the case of the toner 1, except that the complex powder A is changed to the complex powder H in the preparation of the toner 1. The external addition and sieving processes are performed in the same manner as in the case of the toner particles 1 to obtain the toner 9. The results are shown in Table 2.

Preparation of Toner 10

Toner particles 10 having a volume average particle diameter of 6.0 μm are obtained in the same manner as in the case of the toner 1, except that the complex powder A is changed to the complex powder 1 in the preparation of the toner 1. The external addition and sieving processes are performed in the same manner as in the case of the toner particles 1 to obtain the toner 10. The results are shown in Table 2.

Preparation of Toner 11

Toner particles 11 having a volume average particle diameter of 21.0 μm are obtained in the same manner as in the case of the toner 1, except that the coarse particles are recovered by an inertia-type classifier in the preparation of the toner 1. The external addition and sieving processes are performed in the same manner as in the case of the toner particles 1 to obtain the toner 11. The results are shown in Table 2.

Preparation of Toner 12

Toner particles 12 having a volume average particle diameter of 1.8 μm are obtained in the same manner as in the case of the toner 1, except that the fine particles are recovered by an inertia-type classifier in the preparation of the toner 1. The external addition and sieving processes are performed in the same manner as in the case of the toner particles 1 to obtain the toner 12. The results are shown in Table 2.

Preparation of Toner 13

—Preparation of Styrene Acrylic Resin (Styrene-Butyl Acrylate Copolymer)—

90 parts of styrene and 10 parts of butyl acrylate are polymerized under cumene reflux (146° C. to 156° C., in the presence of 0.01 part of Sn) in a reactor to synthesize a styrene acrylic resin that is a styrene-butyl acrylate copolymer.

—Preparation of Toner 13—

Toner particles 13 having a volume average particle diameter of 7.2 μm are obtained in the same manner as in the case of the toner 1, except that the polyester resin is changed to the above-described styrene acrylic resin in the preparation of the toner 1. The external addition and sieving processes are performed in the same manner as in the case of the toner particles 1 to obtain the toner 13. The results are shown in Table 2.

Preparation of Toner 14

Toner particles 14 having a volume average particle diameter of 8.6 μm are obtained in the same manner as in the case of the toner 1, except that the complex powder A is changed to the complex powder J in the preparation of the toner 1. The external addition and sieving processes are performed in the same manner as in the case of the toner particles 1 to obtain the toner 14. The results are shown in Table 2.

Preparation of Toner 15

Toner particles 15 having a volume average particle diameter of 5.7 μm are obtained in the same manner as in the case of the toner 1, except that the complex powder A is changed to the complex powder K in the preparation of the toner 1. The external addition and sieving processes are performed in the same manner as in the case of the toner particles 1 to obtain the toner 15. The results are shown in Table 2.

Preparation of Toner 16

—Preparation of Polyester Resin Particle Dispersion 1—

100 parts of a polyester resin (polyester resin that is synthesized using a tin catalyst containing propylene oxide 2-mol adduct/ethylene oxide 2-mol adduct of bisphenol A, a terephthalic acid and a trimellitic acid as major components), 50 parts of methyl ethyl ketone, 30 parts of isopropyl alcohol, and 5 parts of a 10% aqueous ammonia solution are put into a separable flask and mixed sufficiently to be dissolved. Then, while performing heating stirring at 40° C., ion exchange water is added dropwise at a liquid sending rate of 8 g/min using a liquid sending pump.

The solution in the flask is made uniformly cloudy, and then the liquid sending rate is raised to 25 g/min to cause phase inversion, and when the liquid sending amount is 135 parts, the dropping is stopped. Thereafter, the solvent is removed under reduced pressure to obtain a polyester resin particle dispersion 1. The volume average particle diameter of the obtained polyester resin particles is 158 nm, and the solid content concentration of the resin particles is 39%.

—Preparation of Release Agent Dispersion 1—

Ester Wax WEP 5 (manufactured by NOF Corporation): 500 parts

Anionic Surfactant (Daiichi Kogyo Seiyaku Co., Ltd: NEOGEN RK): 50 parts

Ion Exchange Water: 2000 parts

The above components are heated to 110° C. and dispersed using a homogenizer (TKA Werke GmbH & Co. KG: Ultra Turrax P50). Then, a dispersion treatment is performed by a Manton-Gaulin high-pressure homogenizer (Gaulin Corporation) to prepare a release agent dispersion 1 (release agent concentration: 23%) in which a release agent having an average particle diameter of 0.24 μm is dispersed.

—Preparation of Toner 16—

Polyester Resin Particle Dispersion 1: 280 parts

Complex Powder A: 20 parts

Anionic Surfactant (dowfax 2A1, 20% aqueous solution): 8 parts

Release Agent Dispersion 1: 60 parts

Among the above raw materials, the polyester resin particle dispersion 1, anionic surfactant, and 340 parts of ion exchange water are put into a polymerization tank provided with a pH meter, a stirring blade, and a thermometer, and are stirred for 15 minutes at 150 rpm.

Next, the release agent dispersion 1 is added and mixed, and then a 0.3 M-nitric acid aqueous solution is added to the raw material mixture to obtain a raw material dispersion prepared to have a pH of 4.2.

While a shear force is applied to the raw material dispersion at 3,000 rpm using an Ultra Turrax, 27 parts of a nitric acid aqueous solution containing 1% of aluminum sulfate are added dropwise as a flocculant. During the dropping of the flocculant, the viscosity of the raw material dispersion rapidly increases. Accordingly, at the time when the viscosity increases, the drop rate is reduced to uniformly distribute the flocculant. When the dropping of the flocculant ends, the rotation rate is further raised to 5,000 rpm and the stirring is performed for 5 minutes.

While being warmed to 30° C. using a mantle heater, the raw material dispersion is stirred at 350 to 600 rpm. After stirring for 30 minutes, stable formation of a primary particle diameter is perceived using Coulter Counter [TA-II] (aperture diameter: 50 μm; manufactured by Beckman Coulter, Inc.), and then the temperature is raised to 42° C. at 0.1° C./rain to grow aggregated particles. With the perception of the growth of aggregated particles as necessary using the Coulter Counter, the aggregation temperature and rotation rate of stirring are appropriately adjusted by the aggregation rate.

Meanwhile, in order to form a coating layer on the surfaces of the aggregated particles, 30 parts of ion exchange water and 4.2 parts of an anionic surfactant (dowfax 2A1, 20% aqueous solution) are added to 110 parts of a polyester resin particle dispersion 1 and mixed to provide a solution prepared to have a pH of 3.3 in advance.

When the aggregated particles are grown to have a volume average particle diameter of 5.4 μm, a solution for forming a coating layer prepared in advance is added, and then held for 10 minutes while being stirred. Thereafter, in order to stop the growth of the aggregated particles having a coating layer formed thereon, 1.5 pph of ethylenediaminetetraacetic acid (EDTA) is added with respect to the total amount of the dispersion put into the polymerization tank, and then 1 mol/L of a sodium hydroxide aqueous solution is added to control the pH of the raw material dispersion to 7.5.

Next, in order to coalesce the aggregated particles together, the temperature is raised to 85° C. at a temperature increase rate of 1° C./min while the pH is adjusted to 7.5. The pH is still adjusted to 7.5 to advance the coalescence even after raising to 85° C., and after perception of the coalescence of the aggregated particles by an optical microscope, ice water is injected for rapid cooling at a temperature decrease rate of 10° C./min in order to stop the growth of the particle diameter.

Thereafter, for the purpose of washing the obtained particles, sieving is performed once with a 15 μm-opening mesh. Next, ion exchange water (30° C.) is added in an amount about 10 times the solid content and stirred for 20 minutes, and is then filtered. Furthermore, the solid content remaining on the filter paper is dispersed in a slurry, repeatedly washed four times with ion exchange water of 30° C., and then dried to obtain toner base particles 16 having a volume average particle diameter of 6.1 μm.

Then, with respect to 100 parts of the obtained toner base particles, 1 part of gas phase method silica (manufactured by Nippon Aerosil Co., Ltd., R972, number average primary particle diameter of 43 nm) is mixed by a Henschel mixer (for 10 minutes at 25 m/s) to be externally added, and thus a toner 16 is obtained. The results are shown in Table 2.

Preparation of Toner 17

—Preparation of Polyester Resin 1 not Containing Tin and Titanium—

1,4-cyclohexanedicarboxylic acid: 17.5 parts

Bisphenol A 1 ethylene oxide adduct: 31 parts

Dodecylbenzenesulfonic acid: 0.15 part

The above materials are mixed and put into a reactor provided with a stirrer. The mixture is subjected to polycondensation for 24 hours at 120° C. under a nitrogen atmosphere to obtain a polyester resin 1 not containing tin and titanium.

—Preparation of Toner 17—

Toner particles 17 having a volume average particle diameter of 6.0 μm are obtained in the same manner as in the case of the toner 1, except that the polyester resin is changed to the above-described polyester resin 1 not containing tin and titanium. The external addition and sieving processes are performed in the same manner as in the case of the toner particles 1 to obtain the toner 17. The results are shown in Table 2.

Preparation of Toner 18

Toner particles 18 having a volume average particle diameter of 6.0 μm are obtained in the same manner as in the case of the toner 1, except for change to gas phase method silica (manufactured by Nippon Aerosil Co., Ltd., 8972, number average primary particle diameter of 21 nm) in the external addition and sieving processes for the toner particles 1. The results are shown in Table 2.

Preparation of Comparative Toner 19

Comparative toner particles 19 having a volume average particle diameter of 5.2 μm are obtained in the same manner as in the case of the toner 1, except that the complex powder A is changed to the complex powder L in the preparation of the toner 1. The external addition and sieving processes are performed in the same manner as in the case of the toner particles 1 to obtain the comparative toner 19. The results are shown in Table 2.

Preparation of Comparative Toner 20

Comparative toner particles 20 having a volume average particle diameter of 4.1 μm are obtained in the same manner as in the case of the toner 1, except that the complex powder A is changed to the complex powder M in the preparation of the toner 1. The external addition and sieving processes are performed in the same manner as in the case of the toner particles 1 to obtain the comparative toner 20. The results are shown in Table 2.

Preparation of Comparative Toner 21

Comparative toner particles 21 having a volume average particle diameter of 10.5 μm are obtained in the same manner as in the case of the toner 1, except that the complex powder A is not used in the preparation of the toner 1. The external addition and sieving processes are performed in the same manner as in the case of the toner particles 1 to obtain the comparative toner 21. The results are shown in Table 2.

Evaluation Methods

Preparation of Developer

Preparation of Developers 1 to 18 and Comparative Developers 19 to 21

100 parts of a carrier 1 and 7 parts of an external additive-added toner are mixed for 20 minutes at 40 rpm using a V-blender to prepare developers 1 to 18 and comparative developers 19 to 21.

Surface Smoothness Evaluation

Using the obtained developers 1 to 18 and comparative developers 19 to 21, patches which are formed of a solid image having a size of 4 cm×4 cm are prepared by Docu Print Color 400CP manufactured by Fuji Xerox Co., Ltd with a toner amount of 5.0 g/m$^2$.

The obtained images are visually observed using an optical microscope to evaluate surface smoothness. When the light intensity is set to be constant and the printed patch is observed, the brighter the visual field, the higher the surface smoothness. The evaluation standard is as follows. An evaluation of G2 or higher is considered to be practical for use.

G6: Extremely bright with no problems

G5: Bright with no problems, but less bright than G6.

G4: Bright

G3: Slightly dark

G2: Dark, but usable.

G1: Dark

Light Emission Luminance Evaluation

Using the obtained developers 1 to 18 and comparative developers 19 to 21, patches which are formed of a solid image having a size of 4 cm×4 cm are prepared by Docu Print Color 400CP manufactured by Fuji Xerox Co., Ltd with a toner amount of 3.5 g/m$^2$ using C2 paper. Next, in the dark-room, irradiation with UV light (Handy 3 UV wavelength switching-type UV lamp manufactured by Funakoshi Corporation) having an intensity of 90 μW/cm$^2$ from a position which is positioned above the patch with a distance of 1.0 m therebetween is performed to evaluate the light emission luminance. The evaluation standard is as follows. An evaluation of G2 or higher is considered to be practical for use.

G5: Patch tinged with red and emits light brightly.

G4: Emission of bright light tinged with red from the patch is perceived, but less bright than G5.

G3: Emission of light tinged with red from the patch is perceived.

G2: Emission of light from the patch is slightly perceivable.

G1: Emission of light from the patch may not be perceived.

Hot Offset Evaluation

Using the obtained developers 1 to 18 and comparative developers 19 to 21, patches which are formed of a solid image having a size of 4 cm×4 cm are prepared by Docu Print Color 400CP manufactured by Fuji Xerox Co., Ltd with a toner amount of 15.0 g/m$^2$ using C2 paper. The patch is fixed at a process speed of 600 mm/sec, and the image is fixed using a fixing machine, modified to have a fixing temperature of 220° C., and printed on 20 pieces of paper. An evaluation of G2 or higher is considered to be practical for use.

G5: No occurrence of hot offset

G4: Hot offset occurs at 220° C. on one piece of paper.

G3: Hot offset occurs at 220° C. on two pieces of paper.

G2: Hot offset occurs at 220° C. on three to four pieces of paper.

G1: Hot offset occurs at 220° C. on five or more pieces of paper.

The results are shown in the following Table 2.

TABLE 2

| | Toner | Complex Powder | Fluorescent X-ray Eu Amount A (% by weight) | Fluorescent X-ray Bi Amount B (% by weight) | Eu/Bi (A/B) | Fluorescent X-ray Sn (Ti) Amount C (% by weight) | Eu/Sn (Ti) (A/C) | External Additive Particle Diameter (nm) |
|---|---|---|---|---|---|---|---|---|
| Example 1 | 1 | A | 0.710 | 0.130 | 5.5 | 0.13 | 4.6 | 43 |
| Example 2 | 2 | B | 0.812 | 0.104 | 7.8 | 0.09 | 8.1 | 43 |
| Example 3 | 3 | C | 0.688 | 0.096 | 7.2 | 0.18 | 3.5 | 43 |
| Example 4 | 4 | A | 0.710 | 0.130 | 5.5 | 0.09 | 6.8 | 43 |
| Example 5 | 5 | D | 7.200 | 0.874 | 8.2 | 0.35 | 20.0 | 43 |
| Example 6 | 6 | E | 0.113 | 0.033 | 3.4 | 0.03 | 3.2 | 43 |
| Example 7 | 7 | F | 2.080 | 0.458 | 4.5 | 0.21 | 16.9 | 43 |
| Example 8 | 8 | G | 0.215 | 0.012 | 17.4 | 0.04 | 4.3 | 43 |
| Example 9 | 9 | H | 1.410 | 0.067 | 21.2 | 0.11 | 11.8 | 43 |
| Example 10 | 10 | I | 0.296 | 0.742 | 0.4 | 0.09 | 3.0 | 43 |
| Example 11 | 11 | A | 0.710 | 0.130 | 5.5 | 0.13 | 4.2 | 43 |
| Example 12 | 12 | A | 0.710 | 0.130 | 5.5 | 0.11 | 5.9 | 43 |
| Example 13 | 13 | A | 0.710 | 0.130 | 5.5 | 0.11 | 6.5 | 43 |
| Example 14 | 14 | J | 1.260 | 0.095 | 13.4 | 0.05 | 22.0 | 43 |
| Example 15 | 15 | K | 1.120 | 0.200 | 5.6 | 0.14 | 7.1 | 43 |
| Example 16 | 16 | A | 1.850 | 0.340 | 5.5 | 0.12 | 5.3 | 43 |
| Example 17 | 17 | A | 0.710 | 0.130 | 5.5 | — | — | 43 |
| Example 18 | 18 | A | 0.710 | 0.130 | 5.5 | 0.13 | 4.6 | 21 |
| Comparative Example 1 | 19 | L | 1.010 | 0.000 | — | 0.15 | 6.7 | 43 |
| Comparative Example 2 | 20 | M | 0.000 | 0.120 | — | 0.08 | — | 43 |
| Comparative Example 3 | 21 | — | 0.000 | 0.000 | — | 0.18 | — | 43 |

| | Toner Particle Diameter (μm) | Binder Resin | Complex Type | Sn, Ti | Manufacturing Method | Light Emission Luminance | Smoothness | Hot Offset |
|---|---|---|---|---|---|---|---|---|
| Example 1 | 6.0 | Polyester Resin | $YVO_4$ | Sn | Kneading Pulverization | G5 | G6 | G5 |
| Example 2 | 7.4 | Polyester Resin | $Y_2O_3$ | Sn | Kneading Pulverization | G5 | G6 | G5 |
| Example 3 | 5.8 | Polyester Resin | $Y_2O_2S$ | Sn | Kneading Pulverization | G5 | G6 | G5 |
| Example 4 | 6.2 | Polyester Resin | $YVO_4$ | Ti | Kneading Pulverization | G5 | G6 | G5 |
| Example 5 | 4.8 | Polyester Resin | $YVO_4$ | Sn | Kneading Pulverization | G4 | G5 | G2 |
| Example 6 | 8.2 | Polyester Resin | $YVO_4$ | Sn | Kneading Pulverization | G2 | G3 | G5 |
| Example 7 | 6.9 | Polyester Resin | $YVO_4$ | Sn | Kneading Pulverization | G4 | G5 | G2 |
| Example 8 | 3.9 | Polyester Resin | $YVO_4$ | Sn | Kneading Pulverization | G2 | G2 | G5 |
| Example 9 | 9.5 | Polyester Resin | $YVO_4$ | Sn | Kneading Pulverization | G3 | G4 | G4 |
| Example 10 | 6.0 | Polyester Resin | $YVO_4$ | Sn | Kneading Pulverization | G2 | G4 | G3 |
| Example 11 | 21.0 | Polyester Resin | $YVO_4$ | Sn | Kneading Pulverization | G4 | G5 | G5 |
| Example 12 | 1.8 | Polyester Resin | $YVO_4$ | Sn | Kneading Pulverization | G5 | G5 | G5 |
| Example 13 | 7.2 | Styrene Acrylic Resin | $YVO_4$ | Sn | Kneading Pulverization | G5 | G5 | G4 |

TABLE 2-continued

| | | | | | | | | |
|---|---|---|---|---|---|---|---|---|
| Example 14 | 8.6 | Polyester Resin | $YVO_4$ | Sn | Kneading Pulverization | G4 | G4 | G4 |
| Example 15 | 5.7 | Polyester Resin | $YVO_4$ | Sn | Kneading Pulverization | G5 | G5 | G4 |
| Example 16 | 6.1 | Polyester Resin | $YVO_4$ | Sn | Aggregation | G4 | G4 | G4 |
| Example 17 | 6.0 | Polyester Resin | $YVO_4$ | — | Kneading Pulverization | G5 | G4 | G5 |
| Example 18 | 6.0 | Polyester Resin | $YVO_4$ | Sn | Kneading Pulverization | G5 | G4 | G5 |
| Comparative Example 1 | 5.2 | Polyester Resin | $YVO_4$ | Sn | Kneading Pulverization | G3 | G1 | G5 |
| Comparative Example 2 | 4.1 | Polyester Resin | $YVO_4$ | Sn | Kneading Pulverization | G1 | G3 | G5 |
| Comparative Example 3 | 10.5 | Polyester Resin | — | Sn | Kneading Pulverization | G1 | G1 | G5 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transparent electrostatic charge image developing toner comprising:

a binder resin;

0.2% by weight to 7.0% by weight of europium;

0.02% by weight to 0.7% by weight of bismuth; and an element selected from tin and titanium, wherein the europium and bismuth are contained a complex selected from the group consisting of a $YVO_4$:Eu,Bi complex, a $Y_2O_3$:Eu,Bi complex, and a $Y_2OS$:Eu,Bi complex, and the transparent electrostatic charge image developing toner satisfies the following formula:

$$3 \leq A/C: \leq 20$$

where:

A is a content (% by weight) of the europium in the toner that is measured by X-ray fluorescence analysis, and C is a content (% by weight) of the element selected from tin and titanium in a toner cross-section that is measured by transmission electron microscope enemy dispersive X-ray analysis.

2. The transparent electrostatic charge image developing toner according to claim 1, wherein the transparent electrostatic charge image developing toner has ultraviolet absorptivity.

3. The transparent electrostatic charge image developing toner according to claim 1, wherein the transparent electrostatic charge image developing toner satisfies the following formula:

$$3 \leq A/B \leq 20$$

wherein B is a content (% by weight) of the bismuth in the toner that is measured by X-ray fluorescence analysis.

4. The transparent electrostatic charge image developing toner according to claim 1, wherein a volume average particle diameter Dv of the transparent electrostatic charge image developing toner is from 4 μm to 10 μm.

5. The transparent electrostatic charge image developing toner according to claim 1, wherein the toner further comprises an external additive having a number average primary particle diameter in the range of 18 nm or less or 25 nm or greater.

6. The transparent electrostatic charge image developing toner according to claim 1, wherein the binder resin contains a polyester resin.

7. A method of manufacturing the transparent electrostatic charge image developing toner according to claim 1, the method comprising:

kneading a toner forming material that contains a binder resin and a compound containing europium and bismuth;

cooling the kneaded material formed by the kneading;

pulverizing the kneaded material cooled by the cooling; and classifying the kneaded material pulverized by the pulverizing.

8. An electrostatic charge image developer comprising the transparent electrostatic charge image developing toner according to claim 1.

9. A toner cartridge comprising:

a toner accommodation chamber, wherein the toner accommodation chamber contains the transparent electrostatic charge image developing toner according to claim 1.

10. An image forming apparatus comprising:

an image holding member;

a charging unit that charges a surface of the image holding member;

an exposure unit that exposes the charged image holding member to form an electrostatic latent image on the surface of the image holding member;

a developing unit that develops the electrostatic latent image with a developer including a toner to form a toner image;

a transfer unit that transfers the toner image onto a surface of a transfer member from the image holding member; and a fixing unit that fixes the toner image transferred onto the surface of the transfer member, wherein the toner is the transparent electrostatic charge image developing toner according to claim 1.

11. An image forming method comprising:

charging a surface of an image holding member;

forming an electrostatic latent image on the surface of the image holding member;

developing the electrostatic latent image formed on the surface of the image holding member with a developer including a toner to form a toner image;

transferring the toner image onto a surface of a transfer member; and fixing the toner image transferred onto the surface of the transfer member, wherein the toner is the transparent electrostatic charge image developing toner according to claim 1.

* * * * *